US006295810B1

(12) United States Patent
Langen et al.

(10) Patent No.: US 6,295,810 B1
(45) Date of Patent: Oct. 2, 2001

(54) HYDROSTATIC DRIVE SYSTEM

(75) Inventors: Alfred Langen, Goldbach; Horst Deininger, Horstein-Alzenau, both of (DE)

(73) Assignee: Linde Aktiengesellschaft (DE)

( * ) Notice: Subject to any disclaimer, the term of this patent is extended or adjusted under 35 U.S.C. 154(b) by 0 days.

(21) Appl. No.: 09/358,945

(22) Filed: Jul. 22, 1999

(30) Foreign Application Priority Data

Aug. 3, 1998 (DE) ..... 198 34 955

(51) Int. Cl.[7] ..... F16D 31/02; G01F 1/28
(52) U.S. Cl. ..... 60/450; 73/861.71
(58) Field of Search ..... 60/445, 448, 450; 91/466, 467; 73/861.71, 861.73

(56) References Cited

U.S. PATENT DOCUMENTS

| | | | | |
|---|---|---|---|---|
| 3,635,021 | * | 1/1972 | McMillen et al. | 60/450 |
| 3,713,291 | * | 1/1973 | Kubik | 60/446 X |
| 3,722,278 | * | 3/1973 | Young et al. | 73/861.71 |
| 3,759,099 | * | 9/1973 | McGregor | 73/861.53 |
| 3,827,239 | * | 8/1974 | Ilrich, Jr. | 60/448 X |
| 4,420,937 | * | 12/1983 | Naruse et al. | 60/450 |
| 4,507,976 | * | 4/1985 | Banko | 73/761.54 |
| 4,914,913 | * | 4/1990 | St Germain et al. | 60/450 X |
| 5,033,311 | * | 7/1991 | Custer | 73/861.53 X |
| 5,085,051 | * | 2/1992 | Hirata | 60/450 X |
| 5,526,695 | * | 6/1996 | Kilayko | 73/861.71 |
| 5,535,587 | * | 7/1996 | Tanaka et al. | 60/450 X |
| 5,945,608 | * | 8/1999 | Hutchinson | 73/861.71 X |

* cited by examiner

*Primary Examiner*—John E. Ryznic
(74) *Attorney, Agent, or Firm*—Webb Ziesenheim Logsdon Orkin & Hanson, P.C.

(57) ABSTRACT

A hydrostatic drive system with an adjustable pump in the delivery flow has at least one consuming device connected to the pump. Associated with each consuming device are actuation devices that specify the direction of movement and the speed of movement. A control valve device controls the direction of movement and the speed of movement. The delivery flow of the pump can be adjusted to the hydraulic flow required by the actuated consuming devices. The hydrostatic drive system makes possible the operation of the consuming devices independently of the load and the operation of the consuming devices independently of the direction of the load, in a simple manner and with lower energy losses. Associated with each consuming device is a delivery flow sensor that measures the hydraulic flow discharged from the consuming device to a reservoir, and/or a delivery flow sensor that measures the hydraulic flow from a delivery line of the pump to the consuming device. Each delivery flow sensor is connected to an electronic control. The electronic control is connected to the actuation device, to the control valve device and to a delivery flow setting device of the pump. The electronic control controls the control valve device and/or the delivery flow setting device of the pump as a function of the direction of movement and the speed of movement specified at the actuation device and of the hydraulic flow discharged from the consuming device measured at the delivery flow sensor and/or the hydraulic flow admitted to the consuming device measured at the delivery flow sensor.

33 Claims, 8 Drawing Sheets

8a
24
54a
47a
46a
53a
41a
44a
45a
40a
52a
57a
49a
56a
55a
48a
42a
50a
43a
18
25
4
4a
26
2
1
3
76
74
60
62a
63a
68a
65a
66a
69a
64a
67a
73a
32
30
9a
10
9
33
37
27
13
14
15
5
20
22
34
11a
16
17
11b
35
23
21
7
19
12
47b
54b
41b
42b
48b
51b
62b
64b
67b
66b
69b
63b
68b
65b
73b
29
86
6
49b
28
61
75
71
70
72

4
4a
1
2
3
12
7a
81
91
85
90
82
88
86
80
83
9a
89
87
84
98
95
41c
48c
97
94
96
8c
93
54c
42c
92
6a
5a
70
72

HYDROSTATIC DRIVE SYSTEM

BACKGROUND OF THE INVENTION

1. Field of the Invention

This invention relates to a hydrostatic drive system with an adjustable pump in the delivery flow and at least one consuming device connected to the pump. More specifically associated with each consuming device are actuation means that specify the direction of movement and the speed of movement, and a control valve to control the direction of movement and the speed of movement, and wherein the delivery flow of the pump can be adjusted to the hydraulic fluid flow required by the actuated consuming devices.

2. Background Information

Similar hydrostatic drive systems for the control of a plurality of consuming devices are load-sensing drive systems in which the delivery flow of the pump can be adjusted to the hydraulic flow required by the consuming devices. In these systems, when the consuming device is actuated by the control valve, the load pressure of the consuming device is measured, transmitted to a pump regulator that controls the delivery volume of the pump and compared to the delivery pressure of the pump.

The speed of the consuming device is controlled by a control valve that, when actuation means are actuated, is deflected to correspond to the specified speed and direction of movement. The opening width of the control valve thereby forms a measurement throttle that determines the speed of movement of the consuming device. By measuring the load pressure of the consuming device and comparing it with the delivery pressure supplied by the pump at a pump regulator that controls the delivery volume of the pump, the pump thereby delivers a flow that corresponds to the hydraulic flow required by the consuming device. Thereby a delivery pressure is achieved that is higher than the load pressure of the consuming device by a defined control pressure that equals the spring bias on the pump regulator.

In the event of a simultaneous actuation of a plurality of consuming devices, the highest load pressure of the actuated consuming devices is transmitted to the pump regulator, as a result of which a delivery pressure is set that is above the highest load pressure by the control pressure.

For operation of the consuming devices independently of the load, associated with each control valve there is a pressure balance that forms an additional throttle point and keeps the pressure differential at the measurement throttle formed by the opening width of the control valve constant. The pressure balances that are associated with the control valves thereby prevent the consuming devices with the lower load pressures from being operated at an excessive speed of movement. The consuming devices are thereby operated independently of the load at the respective speed of movement set at the control valve.

With such a control valve, however, for the control of the consuming devices at the control valve and at the pressure balance associated with the control valve, there must be a pressure difference. The level of this pressure difference thereby determines the level of the control pressure set at the pump regulator. Because the delivery pressure supplied by the pump equals the sum of the load pressure and the control pressure, the level of the control pressure results in pressure losses and thus in energy losses in the hydrostatic drive system.

In addition, with such a control consisting of a pressure balance and control valve, only the hydraulic flow to the respective consuming device can be controlled. In the event of a change in the load direction of the load being applied to the consuming device, for example in the event of a change from a positive load to a negative load, there is an increase in the speed of movement of the consuming device. To prevent such an increase in the speed of movement in the event of a change in the direction of the load, corresponding valve means, for example braking valves, must be provided on the discharge side of the consuming device, which makes the construction more complicated and expensive.

DE 37 16 200 C2 describes a control and regulation device for a hydrostatic drive system with a pump and a plurality of consuming devices, in which the speed of movement of each consuming device is compared with a specified speed of movement in an electronic control, and the delivery of the pump is adjusted so that the set speed of movement of the consuming devices can be achieved with low energy losses. The measurement of the actual speed of movement is thereby measured by position or speed-of-rotation sensors on the consuming devices, or by flow meters, in particular rotating impeller wheels, by which the delivery flow of a consuming device can be measured. Position or speed-of-rotation sensors are expensive and complicated, however, and must also be located in the immediate vicinity of the consuming device. When such a drive system is used in a machine such as an excavator, for example, however, the consuming devices are exposed to environmental factors such as dirt, moisture, etc. The sensors must also be protected against these environmental influences. The electrical connections between the sensors that are located on the consuming devices and the electronic control must also be protected against mechanical damage. This environmental protection is both complicated and expensive. When flow meters are used, of course, the consuming devices can be operated independently of the load, but if the direction of the load being exerted on the consuming device changes, for example from a positive to a negative load, the consuming device cannot be operated independently of the load.

The object of the invention is therefore to make available a hydrostatic drive system of the type described above that makes it possible to operate the consuming devices independently of the load, and to operate the consuming devices independently of the direction of the load with low energy losses, thereby requiring little construction effort and expense.

SUMMARY OF THE INVENTION

The invention teaches that associated with each consuming device is a delivery flow sensor that measures the hydraulic flow out of the consuming device to a reservoir, and/or a delivery flow sensor that measures the hydraulic flow into the consuming device from a delivery line of the pump. The delivery flow sensor is connected with an electronic control. The electronic control is connected with the actuation means, the control valve device and a delivery flow adjustment device of the pump. The electronic control controls the control valve device and/or the delivery flow adjustment device as a function of the direction of movement and speed of movement specified by the actuation means as well as the hydraulic flow into and/or out of the consuming device a s measured by the delivery flow sensor.

When a consuming device is actuated, the hydraulic flow into and/or out of the consuming device is determined by the electronic control and is compared with the speed setpoint set on the actuation means. The delivery flow of the pump is calculated by the electronic control on the basis of the speed of movement set on the actuation means, and the delivery flow setting device of the pump is actuated accordingly. The control valve device is actuated such that no pressure decrease occurs at that point. As a result of the measurement of the speed of movement of the consuming device on the basis of the incoming and/or outgoing hydraulic flow and a control of the delivery flow setting device of the pump or of the control valve device, the consuming device can be actuated independently of the load at the speed of movement specified at the actuation means. The operation of the consuming device independently of the direction of the load is also possible as a result of the control of the control valve device as a function of the hydraulic flow discharged from the consuming device.

When a plurality of consuming devices is actuated simultaneously, on the basis of the speeds of movement of the actuated consuming devices set at the actuation means, a delivery flow is calculated and the delivery flow setting device of the pump is actuated. As a result of the actuation of the control valve device as a function of the hydraulic flow into and/or out of the respective consuming devices, it is possible to prevent the priority flow of hydraulic fluid to the consuming devices with the lower load pressure. The pump delivery current is thus divided between the actuated consuming devices independently of the load. The control of the consuming devices as a function of the outgoing hydraulic flow also makes it possible to operate the consuming devices independently of the direction of the load.

To adjust the delivery volume of the pump to the hydraulic flow required by the consuming devices, a control pressure is not necessary, as a result of which the energy losses that occur are small. In addition, no additional valves are necessary for the control of the consuming devices independently of the direction of the load. The valve components of the control valve device can thereby be optimized for low flow resistances. The pump can be a constant delivery pump, the delivery flow of which can be adjusted by the drive speed of a drive machine. The pump may be a variable delivery volume pump in which the delivery flow can be varied by a delivery flow adjustment device. The speed of rotation of a drive machine is also variable. The actuation of the control valve devices by the electronic control also has the advantage that when a plurality of consuming devices is actuated simultaneously, the consuming devices can be operated with any desired priorities, in which case, for example under operating conditions in which the hydraulic flow required by the consuming devices exceeds the maximum delivery flow of the pump, the control valve devices can be actuated such that the consuming devices can be operated at reduced speeds of movement but in the same ratio of speeds, or priority can be given to the operation of certain consuming devices. In addition, the electronic control makes possible an automatic operation or a programmable operation of the drive system.

In one embodiment of the invention, in which the consuming device is a double-action consuming device, the consuming device can be connected by the control valve device to a delivery line of the pump and a return line that is in communication with a reservoir, whereby delivery flow sensors are located in the respective delivery line and return line. As a result, it becomes possible in a simple manner to measure the hydraulic flow into and out of the consuming device. Additionally, the electronic control device can control the speed of movement of the consuming device independently of the load applied to the consuming device and the direction of the load to the speed set at the actuation means. The delivery flow sensors can thereby be located upstream or downstream of the control valve device. For example, the delivery flow sensors may be in the delivery line leading from the pump to the control valve and in the return line leading from the control valve device to the reservoir, or in the hydraulic lines that lead from the control valve device to the consuming device. The installation of the delivery flow sensors in the delivery line and in the return line of the control valve device is advantageous when there is a double-action consuming device. For example, the delivery flow sensor located in the delivery line carrying the flow into the consuming device measures the flow to the consuming device independently of the switched position of the control valve device, and the delivery flow sensor in the return line acting as the discharge line measures the hydraulic flow discharged from the consuming device.

The difference in surface area between the piston-side and the rod-side of a consuming device, that is a hydraulic cylinder, for example, is thereby stored in the electronic control. The electronic control can calculate a speed of movement of the consuming device on the basis of the different hydraulic flows in the piston-side and the piston-rod side of the hydraulic cylinder measured by the delivery flow sensors. The installation of two delivery flow sensors also has the advantage that it becomes possible to detect in the electronic control whether an increase in the speed of the consuming device was caused by the actuation of an additional consuming device with a higher load pressure and thus an increase of the hydraulic flow measured by the admission-side delivery flow sensor and by the discharge-side delivery flow sensor, or whether it was caused by the application of a negative load to the consuming device, and thus an increase in the hydraulic flow measured by the delivery flow sensor located in the discharge line. It is thereby possible to actuate the control valve device as a function of the admission cross section or the discharge cross section. The use of two delivery flow sensors has the further advantage that malfunctions of the valve devices can be detected, as a result of which there is a high degree of operational safety and reliability.

In an additional embodiment of the invention, in which the consuming device is a double-action consuming device, the consuming device can be connected by the control valve device to a delivery line of the pump and a return line that leads to the reservoir. A delivery flow sensor is located in the return line from the control valve device to the reservoir. As a result of the measurement of the hydraulic flow discharged from the double-action consuming device, it becomes possible in a simple manner to measure the speed of movement of the consuming device. Only one delivery flow sensor is necessary to operate the consuming device independently of the load and independently of the direction of the load.

In an additional embodiment of the invention, in which the consuming device is a single-action consuming device, when the consuming device is connected to the pump by the control valve device, there is a delivery flow sensor in a hydraulic line that leads from the control valve device to the consuming device. When the consuming device is connected by the control valve device to the reservoir, a delivery flow sensor is provided in the return line that leads from the control valve device to the reservoir. As a result, with a single-action consuming device in a first switched position of the control valve device (for example to lift a load) the hydraulic flow to the consuming device and, in a second switched position (for example to lower a load), the hydraulic flow out of the consuming device can each be measured by means of respective delivery flow sensors. In both operating conditions the speed of movement of the consuming device can thus be determined, and the electronic control makes possible the operation of the consuming device independently of the load and independently of the direction of the load.

In one advantageous refinement, the control valve device is connected to a delivery line of the pump and a return line that is in communication with a reservoir, and is also in communication with a circulation line. The circulation line, in a first switched position of the control valve device, makes possible a connection between the hydraulic line that is in communication with the consuming device and the return line. In a second switched position of the control valve device the circulation line makes possible a connection of the delivery line with the hydraulic line. A delivery flow sensor is located in the circulation line. It is thereby possible, in both switched positions of the control valve device, to measure the hydraulic flow to and/or from the consuming device with a delivery flow sensor located in the circulation line. This reduces the cost of construction.

In an additional embodiment of the invention, in which the consuming device is a single-action consuming device, the invention provides a delivery flow sensor located in a hydraulic line that leads from the control valve device to the consuming device. There is a flow regulator to control the hydraulic flow from the consuming device to the reservoir independently of the load. The delivery flow sensor thereby makes possible the operation of the consuming device in a switched position to raise a load independently of the load and independently of the direction of the load. In a switched position to lower a load, the flow regulator makes it possible to operate the consuming device independently of the load and the direction of the load.

In one embodiment, the control valve device has a reversing valve that controls the direction of movement of the consuming device and at least one control valve that controls the speed of movement of the consuming device. As a result of the presence of a control valve in each of the hydraulic lines that lead from the reversing valve to the consuming device, it is thereby possible, for example when the consuming device in question is a double-action consuming device, to control the hydraulic flow into and out of the consuming device by respective control valves independently of one another. The reversing valve thereby determines the direction of movement of the consuming device. It is thereby possible, in the event of a hydraulic flow into the consuming device, to throttle only the control valve that is located in the admission-side hydraulic line, and thus to prevent an increase in the speed of movement of the consuming device in the event of the actuation of an additional consuming device with a higher load pressure. In the event of a negative load applied to the consuming device, an increase in the speed can be counteracted by throttling the control valve that is located in the discharge-side hydraulic line.

In one embodiment of the invention, the control valve device is a directional control valve that controls the direction of movement of the consuming device and the speed of movement of the consuming device and is throttling in intermediate positions. That results in a reduced cost of manufacture, because only one valve element is necessary to control the direction of movement and the speed of movement of the consuming device.

In one refinement of the invention, a seat valve that opens toward the consuming device is located in each of the hydraulic lines leading from the control valve device to the consuming device, which seat valve can be moved toward a closed position by the load pressure of the consuming device and by a spring. It thereby becomes possible in a simple manner to block the consuming device that is actuated by the control valve device in the neutral position with no leakage of hydraulic fluid.

The cost of manufacture can thereby be reduced if the control valve is realized in the form of a seat valve. The control valve thus controls the admission flow and/or the discharge flow, and is simultaneously used to block the consuming device with no leakage of hydraulic fluid, as a result of which the consuming device can be blocked without additional valves.

In one refinement of the invention, the delivery flow sensor is a seat valve. The seat valve is thus integrated into the delivery flow sensor. The result is a low cost of manufacture with few valve components, because the delivery flow sensor also has the function of the seat valve for the blocking of the consuming device with no leakage of hydraulic fluid.

It is appropriate if the connection of the hydraulic line to the return line via the control valve can actuate the seat valve that is located in the hydraulic line into the open position. As a result, when the control valve device is actuated, the seat valve located in the discharge line is moved into the open position, and thus the consuming device is moved.

To actuate the control valve device, there may be two electrically actuated proportional pilot valves that are connected to the electronic control to generate a control pressure to pressurize the control valve device. By two pilot valves, both a control valve device that consists of a directional control valve and a control valve device that consists of a reversing valve and two control valves can be actuated in a simple manner, whereby the level of the control pressure generated by the proportional pilot valve determines the deflection of the control valve.

The reversing valve may have a first control compression chamber that acts in the direction of a first switched position. In the first position the delivery line of the pump is connected to a first hydraulic line and the second hydraulic line is connected to the return line. The reversing valve may have a second control compression chamber that pushes the reversing valve into a second position. In the second position the first hydraulic line is connected to the return line and the second hydraulic line is connected to the delivery line. The first control compression chamber is connected to a control pressure line that is in communication with a first pilot valve. The control pressure line is in communication with a control compression chamber that pushes the control valve located in the first hydraulic line toward the open position. The second control compression chamber is connected to a control pressure line that is in communication with the second pilot valve. The control pressure line is in communication with a control compression chamber that pushes the control valve that is located in the second hydraulic line toward the open position. Consequently, with a double-action consuming device, the reversing valve can be moved into an appropriate switched position by respective pilot valves, and the control valve that is located in this switched position in the admission-side hydraulic line can be moved toward the open position and can control the hydraulic flow to the consuming device.

With a single-action consuming device, the reversing valve may be spring-loaded toward a first switched position in which the hydraulic line is in communication with the return line. The reversing valve can be moved toward a second switched position in which the hydraulic line is connected to the delivery line of the pump by a pilot valve that has a switching magnet. The pilot valve generates a control pressure and is in communication with the electronic control. There is an electrically actuated proportional pilot valve connected with the electronic control that generates a control pressure that acts on the control valve for the actuation of the control valve. The reversing valve can thereby be actuated in a simple manner by a pilot valve that is provided with a switching magnet, because the reversing valve has only two switched positions. The speed of movement of the consuming device is controlled by the control valve actuated by a proportional pilot valve.

The directional control valve may have a first control compression chamber that moves the directional control valve toward a first switched position and a second control compression chamber that moves it toward a second switched position. In the first switched position the delivery line is connected with a first hydraulic line and the second line is connected to the return line. In the second switched position the second hydraulic line is in communication with the delivery line and the first hydraulic line is in communication with the return line. A control pressure line connected to the first pilot valve is in communication with the first control compression chamber and a control pressure line connected to the second pilot valve is in communication with the second control compression chamber. When there is a double-action consuming device, it is thereby possible in a simple manner to actuate a directional control valve into the throttling intermediate positions by two pilot valves.

In an embodiment in which there is a seat valve located in each of the hydraulic lines that lead from the directional control valve to the consuming device, a control pressure line connected to the first pilot valve is in communication with the first control compression chamber of the directional control valve and a control compression chamber of the seat valve located in the first hydraulic line acts in the direction of the opening position. A control pressure line that is connected to the second pilot valve is in communication with the second control compression chamber of the directional control valve and a control compression chamber of the seat valve that is located in the second hydraulic line. This control compression chamber acts in the direction of the opening position. As a result, even with a control valve device that consists of a directional control valve and seat valves located in the hydraulic lines for the leak-free blocking of the consuming device, it is possible, when the directional control valve is pressurized, to actuate the seat valve located in the respective feed line.

In one configuration, the electronic control actuates the pilot valves at some temporal offset from each other. The pilot valve actuated first generates a control pressure that acts on the reversing valve and the control valve or the directional control valve and the seat valve. The control pressure formed by the pilot valve actuated chronologically later generates a control pressure that acts on the control valve or the seat valve. It is thereby possible in a simple manner to actuate both of the control valves or seat valves located in the hydraulic lines. The pilot valve actuated chronologically earlier determines the switching direction of the reversing valve or of the directional control valve and actuates the control valve or seat valve located in the feed line. The pilot valve actuated chronologically later acts only on the control valve or seat valve located in the discharge line and moves it toward the open position.

The pilot valves may each be connected by a control line to the control compression chamber of the reversing valve and to the control compression chamber of the control valve. Located in the control pressure line that runs to the reversing valve is a seat valve that opens toward the control compression chamber of the reversing valve and can be moved by the valve body of the reversing valve into a closed position. When the control compression chamber is pressurized with control pressure, and when the reversing valve is deflected in one position, the seat valve that is moved by the reversing valve into the closed position interrupts the communication of the other control compression chamber with the control pressure line, so that the control pressure available in this control pressure line acts only on the control valve. It is thereby possible in a simple manner to have the chronologically first actuation signal determine the switching direction of the reversing valve and actuate the admission-side control valve, and to have the chronologically later actuation signal actuate only the discharge-side control valve.

With a control valve device that is a directional control valve, it is particularly advantageous if the control pressure line connected to the control compression chamber that acts toward the open position of the seat valve is connected to an annular groove molded in a housing boring of the control side of the directional control valve. The annular groove is connected to the control pressure line of the pilot valve. A boring formed in the control slide is in communication with the annular groove and the control compression chamber of the directional control valve. When the other control compression chamber is pressurized, the boring can be placed in communication with an additional annular groove molded in the housing boring. This annular groove is connected to the return line. When a control compression chamber is actuated with control pressure and thus a defined deflection of the control slide, the communication between the other control compression chamber and the associated control pressure line is interrupted. It is thereby possible in a simple manner to have the chronologically earlier signal actuate both the directional control valve and actuate the seat valve located in the admission line, and the later actuation signal only moves the seat valve located in the discharge line into the open position.

The control valve device, in the neutral position, connects the hydraulic line that runs from the control valve device to the seat valve with the return line. The hydraulic lines that are connected to the seat valves or the control valves are in the neutral position of the reversing valve or of the directional control valve, depressurized toward the reservoir. As a result, the seat valves or the control valves are moved into the closed position and an uncontrolled movement of the consuming device is prevented. That results in a high degree of operational safety.

In one embodiment of the invention, the directional control valve can be actuated by a stepper motor that is connected with the electronic control device. It is thereby possible to actuate the control valve device with reasonable construction effort and expense.

With regard to a high level of operational safety and reliability, the stepper motor is provided with a spring retraction device. The control valve device can thereby be moved into the neutral position with little effort in the event of a power failure.

The seat valve may be actuated by a pilot valve that is mechanically actuated by the directional control valve. When the directional control valve is deflected, the pilot valve is actuated, and thus the seat valve located in the return line is actuated into the open position. As a result, the seat valve is also actuated by the stepper motor, and the seat valve can be easily actuated.

Located in a control pressure line that leads from the control compression chamber that acts in the closing direction of the seat valve to the reservoir there may be a pilot valve that is a spring-loaded check valve. The pilot valve has a valve body that can be moved into the open position by the control slide of the directional control valve. In the event of a deflection of the directional control valve, the pilot valve is moved into the open position. As a result, the control compression chamber of the seat valve that acts in the closing direction is depressurized to the reservoir, and the seat valve can be actuated. It is thereby possible, in a simple manner, to actuate the seat valve that is located in the discharge-side hydraulic line in the event of the actuation of the directional control valve.

The delivery flow sensor may have a valve body that is mounted so that it can move longitudinally in a housing boring. This valve body can be moved by a spring toward a closed position, and can also be moved in the direction of an open position by hydraulic fluid flowing in from the valve body against an active surface thereof, in particular an end surface. The valve body of the delivery flow sensor is thereby moved and deflected by the hydraulic fluid flowing into the valve body against the active surface. The valve body of the delivery flow sensor thus has, for a determined hydraulic flow flowing into the delivery flow sensor in the housing boring on the active surface, an associated opening travel that can be measured in a simple manner.

In one embodiment, the deflection of the valve body of the delivery flow sensor can be measured by an inductive sensor. With an inductive sensor, it is easy to measure the deflection of the valve body of the delivery flow sensor. This is a measurement for the hydraulic flow flowing into or out of the delivery flow sensor and thus the consuming device. It is easy to transmit that measurement to the electronic control. The delivery flow characteristic of the delivery flow sensor is thereby stored in the electronic control.

In an additional embodiment, the valve body of the delivery flow sensor is connected to a Hall sensor. It is thereby also possible to measure the opening travel of the valve body. In such a case, the valve body of the delivery flow sensor may be provided with a permanent magnet body that is effectively connected with a Hall sensor that is located in a housing of the delivery flow sensor and is connected with the electronic control.

The valve body of the delivery flow sensor may be provided with a micro-control device in the vicinity of the active surface. By a micro-control device, for example a micro-control groove or a micro-control segment, it is also possible to measure a small flow of hydraulic fluid flowing to the delivery flow sensor with corresponding accuracy.

In one refinement of the invention, in the event of the actuation of the control valve device toward the neutral position, the admission cross section formed by the control device from the pump to the consuming device can be throttled before the return cross section formed by the control valve device from the consuming device to the reservoir. It thereby becomes possible, with little effort or expense, to achieve an operation of the consuming device that is associated with the control valve device that is independent of the load and independent of the direction of the load on a drive system where there is only one delivery flow sensor located in the return line. If the delivery flow sensor located in the return line measures an excessive hydraulic flow and thus an excessive speed of movement of the consuming device, this situation can be caused by several factors. First, an additional consuming device may have been actuated that has a higher load pressure and thus requires a higher system pressure. As a result, the delivery flow of the pump flows with priority to the consuming device with the lower load. Second, the consuming device may be experiencing a negative load. As a result, more hydraulic fluid flows out of the consuming device than is available to said consuming device on the admission side from the pump. The electronic control can recognize an excessive speed of movement of the consuming device by the delivery flow sensor located in the discharge, although it cannot make any conclusions about the cause. If the speed of movement is too high, the electronic control actuates the control valve device into the neutral position. As a result of the actuation and thus the reduction of the admission cross section before the discharge cross section of the control valve device, under operating conditions in which an additional consuming device is actuated at a higher load pressure, it becomes possible to counteract an increase in the speed of the consuming device. The consuming device can be operated at the speed of movement set at the actuation means. If the delivery flow sensor continues to measure an excessive speed of movement, and thus a negative load is being applied to the consuming device, a further actuation of the control valve device into the neutral position also throttles and thus reduces the discharge cross section. As a result, an increase in speed caused by a negative load can be counteracted.

In operating conditions in which the consuming device is exposed to a negative load, the admission cross section can already be severely throttled or closed. The consuming device may take in too little hydraulic fluid on the admission side via the admission cross section formed at the control valve device. A feeder device may be in communication on the admission side with the return line downstream of the delivery flow sensor. It thereby becomes possible with little effort or expense to prevent cavitation on the admission side of the consuming device.

On a hydrostatic drive system with a flow controller, the flow controller, in a switched position of the control valve device in which the hydraulic line is connected to the return line, may be moved toward a switched position that reduces the discharge cross section formed by the control valve device by the load pressure of the consuming device against the force of a spring. The flow controller can be moved by the spring and the delivery pressure of the pump into a switched position of the control valve in which the hydraulic line is in communication with the delivery line and into a switched position that exposes the admission cross section formed by the control slide. The flow controller is therefore active only in one switched position of the control valve device, in which the hydraulic line is connected to the return line. In this switched position, the flow controller keeps the pressure difference determined by the spring at the discharge cross section of the control valve device constant, as a result of which the speed of the consuming device is controlled as a function of the deflection of the control valve device. In this switched position, the consuming device can therefore be operated independently of the load on the consuming device and independently of the direction of the load on the consuming device. In the second switched position, in which the hydraulic line is connected to the delivery line, the flow controller is in a position that exposes the admission cross section of the control valve device, and is thus not active. In this switched position of the control valve device, the consuming device can be operated independently of the load and independently of the direction of the load as a result of the delivery flow sensor located in the admission line and the electronic control device.

The effort and expense involved in construction can be reduced if the flow controller is integrated into the control slide of the directional control valve.

BRIEF DESCRIPTION OF THE DRAWINGS

Additional features and advantages of the invention are explained in greater detail below, with reference to the exemplary embodiments that are illustrated in the accompanying schematic figures, in which.

DESCRIPTION OF THE PREFERRED EMBODIMENTS

Figure 1:
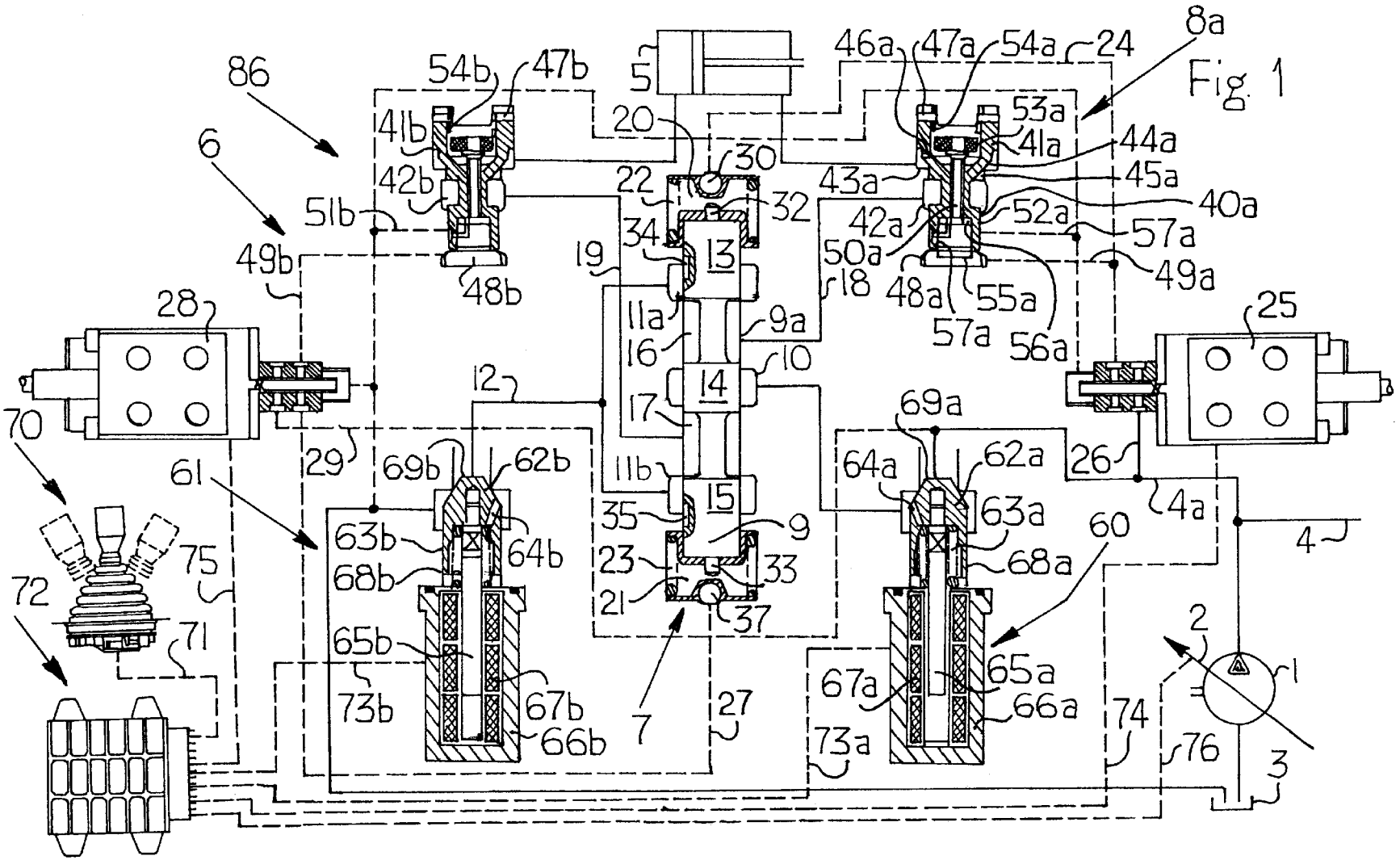
FIG. 1 schematically illustrates a first embodiment of a drive system according to the invention with a control valve device to actuate a double-action consuming device.

FIG. 1 shows a hydrostatic drive system with a variable-delivery pump 1 in the delivery flow. The delivery flow can be varied by a delivery flow adjustment device 2. The pump 1 takes in hydraulic fluid from a reservoir 3 and delivers it into a delivery line 4. A delivery line 4*a* branches off from the delivery line 4 and leads to a consuming device 5. Additional delivery lines that lead to other consuming devices can also be branched off from the delivery line 4.

In the delivery line 4*a* there is a control valve device 6 to control the consuming device 5 which in this case is a double-action hydraulic cylinder. The control valve device 6 has a reversing valve 7 to control the direction of movement of the consuming device 5 and two control valves 8*a*, 8*b* to control the speed of movement of the consuming device 5.

The reversing valve 7 has a valve slide 9 that can move longitudinally in a housing boring 9*a*. In the housing boring 9*a* there is an annular groove 10 that is connected to the delivery line 4*a*. Additional annular grooves 11*a*, 11*b* are connected to a return line 12 that is in communication with the reservoir 3. The valve slide 9 has piston flanges 13, 14, 15 and control grooves 16, 17 located between them. The piston flange 14, in the illustrated middle position of the valve slide 9, closes the annular groove 10. In the vicinity of the control groove 16, a hydraulic line 18 that is in communication with the consuming device 5 is connected to the housing boring 9*a*. An additional hydraulic line 19 that is in communication with the consuming device 5 is connected to the housing boring 9*a* in the vicinity of the control groove 17. The piston flanges 13, 15 are located in the vicinity of the annular grooves 11*a*, 11*b*. In the middle position of the control slide 9, the piston flanges 13, 15 make it possible to connect the hydraulic lines 18, 19 with the return line 12.

To pressurize the control slide 9 of the reversing valve 7, there are control compression chambers 20, 21 in each of which there is a respective spring 22, 23. The control compression chamber 20 is connected to a control pressure line 24, which leads to a pilot valve 25. The pilot valve 25 is an electrically controlled proportional pilot valve, and is connected on the input side by a branch line 26 to the delivery line 4*a*. In this same manner, the control compression chamber 21 is connected to a control pressure line 27 that is in communication with an electrically actuated proportional pilot valve 28, which is connected on the input side by means of a branch line 29 to the delivery line 4*a*. In each of the control pressure lines 24, 27 there is a respective check valve 30, 31 that opens toward the control compression chamber 20, 21 and can be moved into the closed position by the control slide 9 of the reversing valve 7. Actuator pins 32, 33 are provided on the end surfaces of the control slide 9. On the piston flanges 13, 15 there are grooves 34, 35 that, in the event of a corresponding deflection of the control slide 9, make possible a connection between the control compression chamber 30, 31 and the return line 12, and thus depressurize the control compression chamber 30, 31 to the return line 12.

In the hydraulic line 18 there is a control valve 8*a* that has a valve body 41*a* that can move longitudinally in a housing boring 40*a*. The segment of the hydraulic line 18 that is in communication with the reversing valve 7 is connected to an annular groove 42*a* molded in the housing boring 40*a*. The segment of the hydraulic line 18 that is in communication with the consuming device 5 is connected to an annular chamber 43*a* that is formed between the housing boring 40*a* and the valve body 41*a*. Between the annular chamber 43*a* and the annular groove 42*a* valve seat is formed that can be actuated by a conical surface 44*a* formed on the valve body 41*a*. In the vicinity of the conical surface 44*a*, on the valve body 41*a* there is a micro-control groove 45*a*. The valve body 41*a* is pushed toward the closed position by the load pressure of the consuming device 5. A throttle boring 46*a* located in the valve body 41*a* leads from the annular chamber 43*a* to a control compression chamber 47*a* that acts in the closing direction. The valve body 41*a* can be pushed in the opening direction by the control pressure generated by the pilot valve 25. A control compression chamber 48*a* that acts in the opening direction is connected to the control pressure line 24 by a control pressure line 49*a* for this purpose. The control pressure chamber 47*a* can be depressurized to the reservoir 3. In the valve body 41*a* there is a longitudinal boring 50*a* that is in communication with the control compression chamber 47*a* and can be placed in communication by a line 51*a* to the return line 12 with an annular groove 52*a* formed in the valve body 41*a*. At the transition from the longitudinal boring 50*a* into the control compression chamber 47*a* there is a seat valve 53*a* that can be pushed into a closed position by a spring 54*a*. In the opening position, the seat valve 53*a* can be pushed by a piston 55*a* that is located in the control compression chamber 48*a* and can be moved longitudinally in the valve body 41*a* and is connected with the seat valve 53*a* by an actuator pin 56*a* located in the longitudinal boring 50*a*. In the piston 55*a*, there is a connecting boring 57*a* that makes possible a connection between the longitudinal boring 50*a* and the annular groove 52*a* connected to the return line 12.

To control the hydraulic flow flowing in the hydraulic line 19, there is a control valve 8*b*, the construction of which is the same as the control valve 8*a*. The annular groove 42 is thereby connected to the segment of the control pressure line 19 that is in communication with the reversing valve 7, whereby the segment of the hydraulic line 19 that leads to the consuming device 5 is connected to the annular groove 43*b*. The control compression chamber 48*b*that acts in the opening direction is connected by a control line 49*b*. To the control valve 28, and can be pressurized at the control pressure in the control line 27. The control compression chamber can be depressurized by a control pressure line 51*b*, that is connected to the return line 12.

In the delivery line 4*a*, upstream of the reversing valve 7, there is a delivery flow sensor 60. An additional delivery flow sensor 61 is located in the return line 12 downstream of the reversing valve 7. The delivery flow sensors 60, 61 are in effective communication with an inductive sensor 67*a*, 67*b* and have a valve body 62*a*, 62*b* that is a conical surface. The valve body 62*a*, 62*b* actuates a valve seat formed in the delivery line 4*a* or the return line 12. The valve body 62*a*, 62*b* is mounted so that it can move longitudinally in a housing boring 68*a*, 68*b*, and can be moved in the closing direction by a spring 63*a*, 63*b*. The control compression chamber of the delivery flow sensor 60, 61 acting in the closing direction can be pressurized by a boring 64*a*, 64*b* with the pressure downstream of the valve seat of the delivery flow sensor 60, 61. In the opening direction, the valve body 62*a*, 62*b* can be moved by the hydraulic flow flowing into the valve body 62*a*, 62*b* on the end surface 69*a*, 69*b* in the delivery line 4 or in the return line 12. The valve body 62*a*, 62*b* is coupled to a pin 65*a*, 65*b* that is connected with inductive sensors 67*a*, 67*b* located in a housing 66*a*, 66*b* of the delivery flow sensor 60, 61. The inductive sensors 67*a*, 67*b* measure the deflection and thus the opening travel of the valve body 62*a*, 62*b*. The delivery flow sensors 60, 61 are thus deflected by hydraulic fluid flowing in the delivery line 4*a* or the return line 12, whereby the opening travel of the valve bodies 62*a*, 62*b* that corresponds to the hydraulic flow can be measured by the inductive sensors 67*a*, 67*b*.

To actuate the control valve device 6, there are actuation means 70 that are connected by a control line 71 with an electronic control 72. The electronic control 72 is connected on the input side by control lines 73*a*, 73*b* with the delivery flow sensors 60, 61. On the output side, the electronic control 72 is connected by control lines 74, 75 with pilot valves 25, 28 and is connected by a control line 76 with the delivery flow adjustment device 2 of the pump 1.

In the illustrated, non-actuated switched position of the drive system, the control slide 9 of the reversing valve 7 connects the segments of the hydraulic lines 18, 19 that are connected to the annular grooves 42*a*, 42*b* with the return line 12 via the control grooves 16, 17. The valve bodies 41*a*, 41*b* of the control valves 8*a*, 8*b* are moved by the load pressure of the consuming device present in the control compression chamber 47*a*, 47*b* and the springs 54*a*, 54*b* into the closed position. The consuming device 5 is thus blocked without any leakage of hydraulic fluid.

In the event of an actuation of the actuation means 70, a direction of movement and a speed of movement of the consuming device are specified and transmitted to the electronic control 72. The electronic control 72, on the basis of the speed of movement set for the consuming device, calculates a delivery flow of the pump 1 necessary to achieve the desired speed of movement and actuates the delivery flow adjustment device 2 of the pump 1. At the same time, the electronic control 72 actuates the pilot valves 25 and 28, whereby there is some time offset between the actuation of the pilot valves 25, 28.

For example, if the pilot valve 25 is actuated before the actuation of the pilot valve 28, the pilot valve 25 generates a control pressure in the control pressure line 24 that is proportional to the actuation signal. The control pressure is available in the control compression chamber 20 of the reversing slide 7 and moves the control slide 9 downward in FIG. 1. As a result, the actuator pin 33 moves the check valve 31 into the closed position. The control pressure available in the control pressure line 27 that results from the delayed actuation of the pilot valve 29 can thus not get into the control compression chamber 21. The switched direction of the reversing valve 7 and thus the direction of movement of the consuming device is therefore determined by the time difference between the actuation of the pilot valves 25 and 28. The control pressure generated by the pilot valve 25 is also available in the control pressure line 49*a* and moves the control valve 8*a* into the open position. The control valve 8*b* is pushed by the control pressure in the control pressure line 49*b* and generated by the pilot valve 28 into the open position. The delivery line 4*a* is thus connected to the hydraulic line 18. The control valve 8*a* controls the hydraulic fluid flowing to the consuming device. The hydraulic line 19 is in communication via the reversing valve 7 with the return line 12, whereby the hydraulic flow discharged from the consuming device is controlled by the control valve 8*b*. The hydraulic flow into the consuming device 5 is thereby measured by the delivery flow sensor 60 and communicated to the electronic control 72. The delivery flow sensor 61 measures the hydraulic flow out of the consuming device 5 and communicates it to the electronic control 72.

If the actuation means 70 is deflected in the other direction, the electronic control 72 actuates the pilot valve 28 shortly before the pilot valve 25, so that the reversing valve 7 is deflected upward in FIG. 1 by the control pressure in the control pressure line 27. The actuator pin 32 moves the check valve 30 into the closed position. In this switched position, the hydraulic line 19 is connected to the delivery line 41 of the pump 1, and the hydraulic line 18 is connected to the return line 12. The control valve 8*b* thus controls the hydraulic flow to the consuming device, and the control valve 8*a* controls the hydraulic flow discharged from the consuming device. In this switched position, the delivery flow sensor 60 also measures the hydraulic flow to the consuming device 5 and the delivery flow sensor 61 measures the hydraulic flow discharged from the consuming device 5.

The hydraulic flow to the consuming device 5 and the hydraulic flow discharged from the consuming device 5 are thus communicated to the electronic control 72 by the delivery flow sensors 60, 61. As a result, the electronic control 72 can calculate the speed of movement of the consuming device 5. By corresponding regulation interventions on the delivery flow adjustment device 2 of the pump 1 or the pilot valves 25, 28, the consuming device 5 can be operated independently of the load applied to the consuming device 5 at the speed of movement set at the actuation means 70. If an operating condition occurs in which the load applied to the consuming device 5 reverses the direction of the load, for example from a positive to a negative load, the delivery flow sensor 61 located in the return line 12 can measure an increase in the speed of movement of the consuming device 5, and the control valve 8*a* or 8*b* located in the return line can be moved by a corresponding actuation of the pilot valve 25 or 28 by the electronic control 72 toward the closed position. As a result, the speed of movement of the consuming device 5 can be controlled independently of the direction of the load applied to the consuming device 5.

Because of the difference in the surface area on the piston side and on the piston-rod side of a double-reaction cylinder, different hydraulic flows occur at the same speed of movement as a function of the direction of movement, the electronic control 72 is realized so that the difference resulting from the difference in surface area between the piston side and the piston-rod side is taken into consideration in the hydraulic flows measured by the delivery flow sensors.

In the event of an actuation of a plurality of consuming devices connected to the delivery line 4, the delivery flow setting device of the pump 1 is actuated on the basis of the sum signal of all the required hydraulic flows calculated by the electronic control 72. Because the consuming devices in such operating conditions are generally subject to different load pressures, a greater hydraulic flow may be admitted to the consuming devices with a lower load pressure. The hydraulic flow flowing to the respective consuming devices is measured by the delivery flow sensors 60. In the event of an increase of the hydraulic flow, the desired speed of movement set on the actuation means 70 is retained by an actuation of the admission-side control valve 8*a* or 8*b* toward the closed position. In the event of the simultaneous actuation of a plurality of consuming devices at different load pressures, it is thereby possible to operate the consuming device 5 independently of the load. The consuming device 5 can also be operated independently of the direction of the load because of the delivery flow sensor 61 that is located in the return line 12.

If, in the event of the actuation of a plurality of consuming devices, the hydraulic flow requested by the consuming devices exceeds the maximum delivery flow that can be supplied by the pump, the electronic control 72 can distribute the hydraulic flow to the consuming devices on the basis of any desired criteria. The hydraulic flow to the consuming devices can be reduced while maintaining proportionality among the flows, as a result of which all the consuming devices are operated at reduced speeds, and the ratio of the speeds of movement of the consuming devices among one another is maintained. It is also possible to continue to operate individual consuming devices at the desired speed of operation set at the actuation means, and to reduce the hydraulic flow to the other consuming devices. As a result, these latter consuming devices are operated at a reduced speed of movement. It is thereby possible to operate certain consuming devices with priority.

Figure 2:
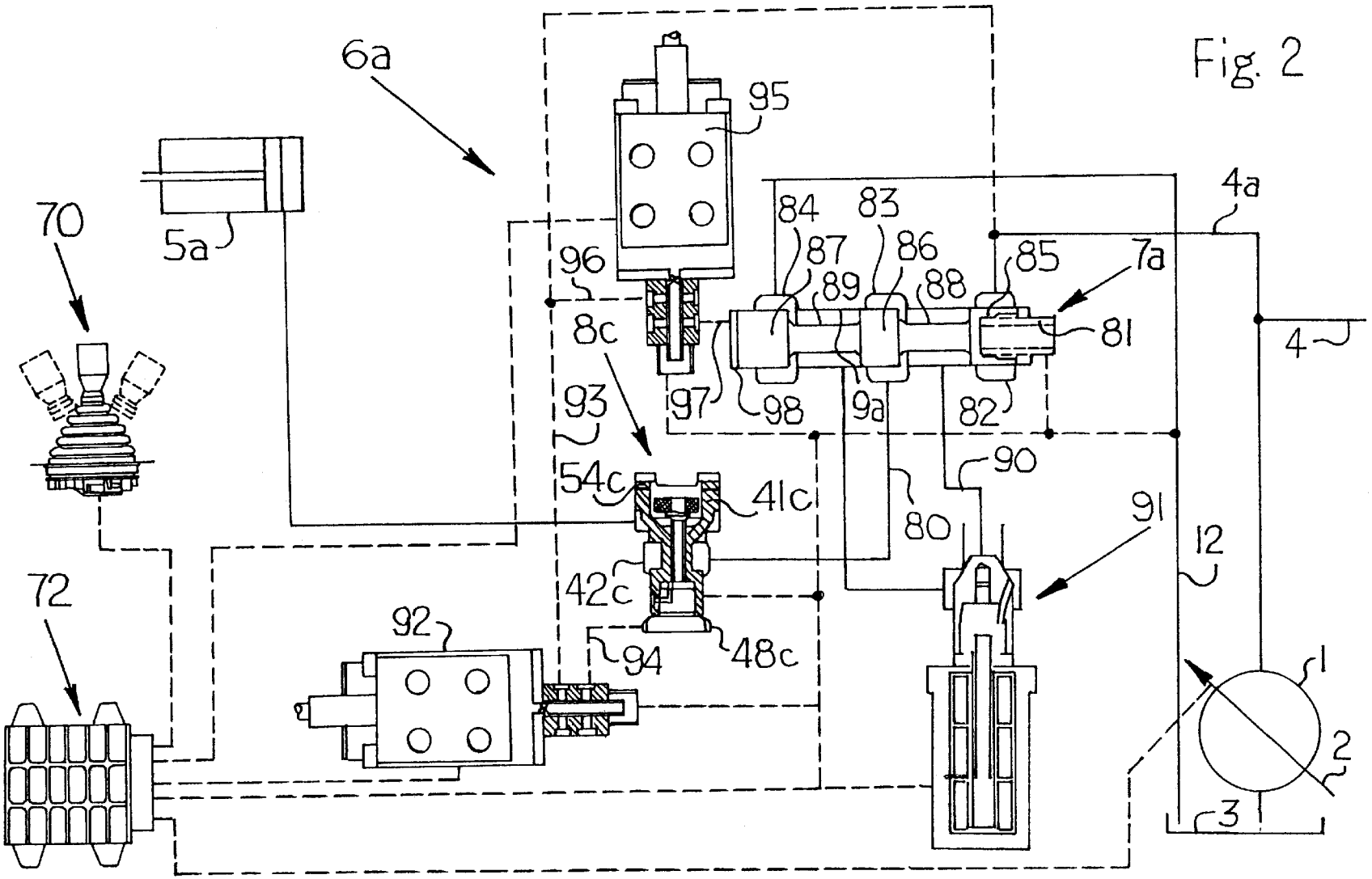
FIG. 2 schematically illustrates a second embodiment of a drive system according to the invention with a control valve device for the actuation of a single-action consuming device.

FIG. 2 shows a drive system according to the invention with a control valve device 6*a* for the actuation of a consuming device 5*a* that is a single-action hydraulic cylinder, such as the lifting cylinder of an industrial truck. The control valve device 6*a* has a reversing valve 7*a* and a control valve 8*c* that is located in a hydraulic line 80 that leads from the reversing valve 7*a* to the consuming device 5*a*. The reversing valve 7*a* has a control slide that is mounted so that it can move longitudinally in a housing boring 9*a* and can be moved toward the illustrated switched position by a spring 81. In the housing boring 9*a* there is an annular groove 82 that is in communication with the delivery line 4*a* of the pump 1. An additional annular groove 83 is connected to the hydraulic line 80. A third annular groove 84 is in communication with the return line 12 that leads to the reservoir 3. The control slide has piston flanges 85, 86, 87 and control grooves 88, 89 located between them. In the switched position illustrated, the piston flange 85 blocks the delivery line 4*a*. In the vicinity of the control grooves 88, 89, a circulation line 90 is connected to the housing boring 9*a*. In the circulation line 90 there is a delivery flow sensor 91, which is substantially the same as the delivery flow sensor 60 or 61 in FIG. 1.

To move the control valve 8*c* toward the open position, there is an electrically actuated proportional pilot valve 92 that is connected on the input side by a branch line 93 to the delivery line 4*a*, and is connected with the control compression chamber 48*c* of the control valve 8*c* acting in the opening direction by a control pressure line 94. To move the reversing valve 7*a*, there is a pilot valve 95 that is provided with a switching magnet and is in communication on the input side with the delivery line 4*a* by a branch line 96. On the output side, the pilot valve 95 is connected by a control pressure line 97 to a control compression chamber 98 of the reversing valve 7*a*. This moves the control slide against the force of the spring 81 toward a second switched position.

In the illustrated neutral position, the segment of the hydraulic line 80 connected to the annular groove 42*c* of the control valve is connected by the control groove 88, the circulation line 90 and the control groove 89 to the annular groove 84, and thus to the return line 12. As a result, the valve body 41*c* of the control valve 8*c* is moved by the load pressure of the consuming device and by the spring 54*c* into the closed position. The control valve 8*c* which is a seat valve thus blocks the consuming device 5*a* with no leakage of hydraulic fluid.

In the event of an actuation of the actuation means 70 to lower a load on the consuming device 5*a*, the deflection of the actuation means 70 plus the direction and speed of movement of the consuming device 51 are specified and communicated to the electronic control 72. Corresponding to the signal of the actuation means 70, the electronic control 72 actuates the pilot valve 92. This generates a control pressure in the control pressure line 94 corresponding to the speed of movement. The control pressure in the control pressure line 94 moves the control valve 8*c* into the open position, so that a hydraulic flow associated with the desired speed of movement can flow out of the consuming device 5*a*. The reversing valve 7*a* is thereby not actuated, so that the hydraulic line 80 is connected by the control groove 88 to the circulation line 90. The circulation line 90 is connected by the control groove 89 with the return line 12. The hydraulic flow discharged from the consuming device 5*a* is measured by the delivery flow sensor 91 and communicated to the electronic control 72 as the actual speed of movement, so that the electronic control 72 actuates the control valve 92. The desired speed of movement set at the actuation means 70 coincides with the actual speed of movement measured at the delivery flow sensor 91. As a result, a load applied to the consuming device 5*a* can be lowered independently of the magnitude of the load at the speed of movement set at the actuation means 70.

To lift a load and to actuate the actuation means 70 accordingly, the electronic control 72 actuates the pilot valve 92 and the pilot valve 95. The pilot valve 95 provided with a switching magnet generates a control pressure in the control pressure line 97 that pressurizes the control compression chamber 98 and deflects the reversing valve 7*a* against the force of the spring into a second switched position to the right in FIG. 2. The pilot valve 92 generates a control pressure that is proportional to the control signal to pressurize the control valve 8*c*. The electronic control 72 also actuates the delivery flow adjustment device 2 of the pump 1. The pump 1 rotates and supplies the delivery flow necessary to achieve the desired speed of movement of the consuming device 5*a* set at the actuation means 70. In the second switched position of the reversing valve 7*a*, the delivery line 4*a* is connected via the control groove 88 to the circulation line that is in communication with the control groove 89 with the annular groove 83 and thus with the hydraulic line 80. In this switched position, the piston flange 87 blocks the annular groove 84. The hydraulic flow flowing to the consuming device 5*a* is therefore measured by the delivery flow sensor 91 and communicated to the electronic control 72, so that the electronic control 72 actuates the delivery flow adjustment device 2 or the control valve 8*c* so that the consuming device 5*a* can be operated independently of the load applied to the consuming device, and in the event of the actuation of additional consuming devices at a higher load pressure, the consuming device 5*a* can be operated at the speed of movement set at the actuation element 70.

Through the circulation line 90 on the reversing line 7*a*, it becomes possible in a simple manner to have the delivery flow sensor 91 carry a flow during both the raising and the lowering of a load, and to have the delivery flow sensor 91 measure the hydraulic flow admitted to the consuming device 5*a* and also the hydraulic flow discharged from the consuming device 5*a*.

Figure 3:
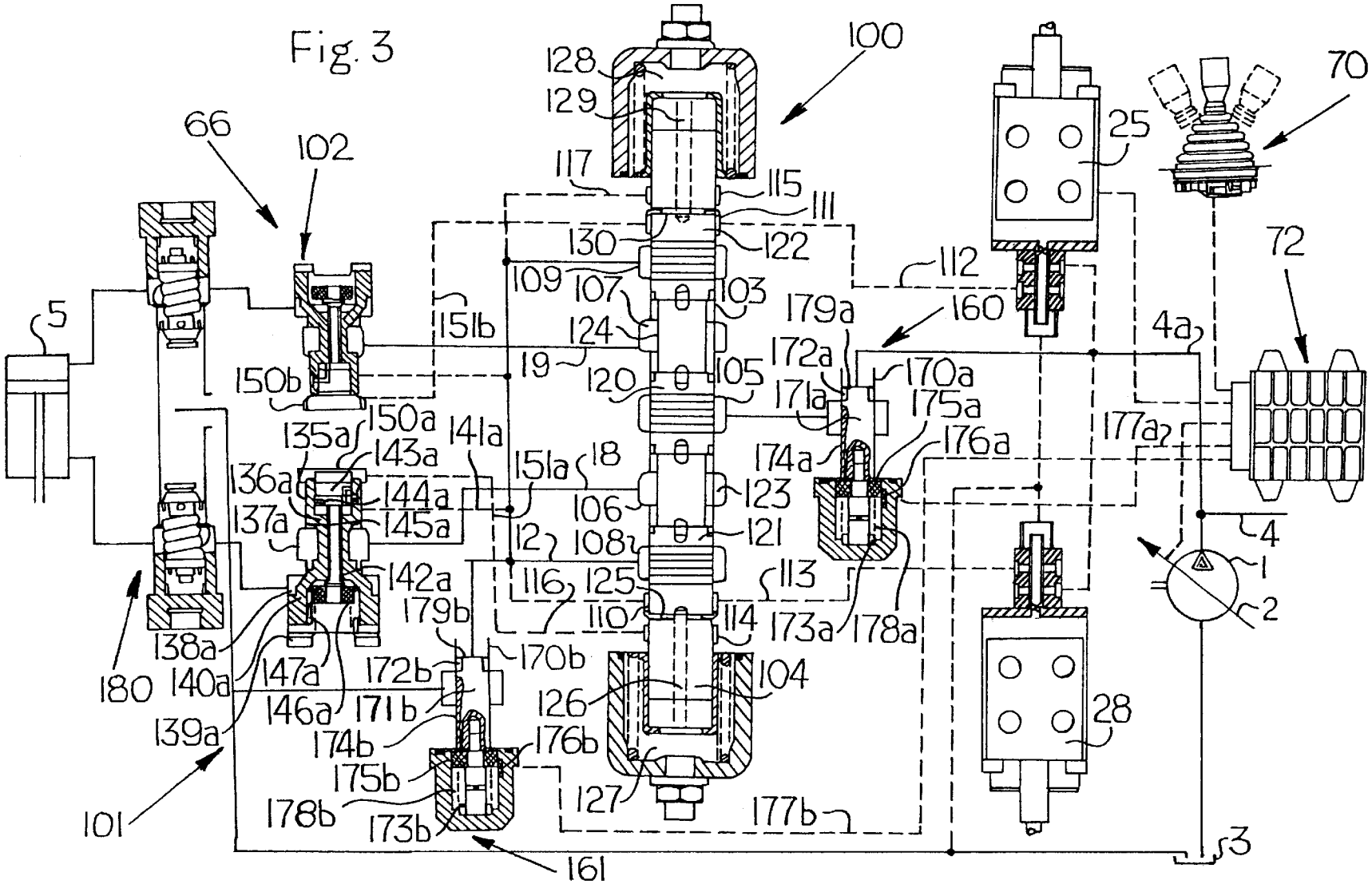
FIG. 3 schematically illustrates a third embodiment of the drive system according to the invention with a control valve device to actuate a double-action consuming device.

FIG. 3 illustrates a third embodiment of the invention. A hydrostatic drive system is shown with a control valve device 6*b* to actuate a consuming device 5 that is a double-action hydraulic cylinder. The control valve device 6*b* has a directional control valve 100 that controls the direction of movement and the speed of movement of the consuming device 5. The directional control valve 100 is connected to the delivery line 4*a* of the pump 1, the hydraulic lines 18, 19 that lead to the consuming device connections and a return line 12, as well as seat valves 101, 102 located in the hydraulic lines 18, 19 for the leak-free blocking of the consuming device 5.

The directional control valve 100 has a control slide 104 mounted so that it can move longitudinally in a housing boring 103. In the housing boring 103 there is an annular groove 105 that is in communication with the delivery line 4*a*. Two of the annular grooves 106, 107 that are next to the annular groove 105 are connected to the hydraulic lines 18, 19. Additional annular grooves 108, 109 formed in the housing boring 104 are in communication with the return line 12. In addition, there are annular grooves 110, 111 in the housing boring 104 which are in communication with control pressure lines 112, 113. Next to the annular grooves 110, 111 there are annular grooves 114, 115 in the housing boring 104. Annular grooves 114, 115 are connected via branch lines 116, 117 to the return line 12. The control pressure lines 112, 113 are in communication with electrically actuated proportional pilot valves 25, 28, which are connected on the input side with the delivery line 4*a*. The control slide 10 of the directional control valve 100 has annular piston flanges 120, 121, 122 and control grooves 123, 124, whereby in the illustrated switched position of the control slide, the annular flange 120 blocks the annular groove 105. The piston flanges 121, 122 block the annular grooves 108, 109. The control groove 123 is in communication with the annular groove 106 and the control groove 124 is in communication with the annular groove 107. In the vicinity of the annular grooves 110, 114 there is an additional annular groove 125 in the control slide 104 that is connected via a transverse boring and a longitudinal boring 126 that is in communication with it to a control compression chamber 127. In the same manner, a control compression chamber 128 is connected via a longitudinal boring 129 and a transverse boring to an annular groove 130 that is formed in the vicinity of the annular grooves 111, 115 in the control slide 104. In the illustrated neutral position of the control slide 104, the annular groove 125 is in communication with the annular groove 110 and the annular groove 130 with the annular groove 111.

The seat valve 101 has a valve body 136*a* that can move longitudinally in a housing boring 135*a*. A conical surface actuates a valve seat formed between an annular groove 137*a* that is shaped in the housing boring 135*a* and is in communication with the annular groove 106, and an annular chamber 138*a* that is formed between the valve body 136*a* and the housing boring 135*a* and is in communication with a consuming device connection of the consuming device. The valve body 136*a* is moved toward the closed position by the load pressure of the consuming device 5, whereby a control compression chamber 139*a* is in communication by a throttle boring 140*a* with the annular chamber 138*a*. The control compression chamber 139*a* can be connected by a relief line 141*a* to the return line 12. A longitudinal boring 142*a* in the valve body 136*a* that is in communication with the control compression chamber 139*a* can be connected by a boring 144*a* located in a piston 143*a* to an annular groove 145*a* formed on the valve body 136*a*. In the control compression chamber 139*a* there is a relief valve 146*a* that is a seat valve and actuates the longitudinal boring 142*a*. The relief valve 146*a* can be moved toward a closed position by a spring 147*a*. The relief valve 146*a* can be moved by the piston 143*a* toward an open position. In the longitudinal boring 142*a* there are actuation devices that are connected to the piston 143*a* and to the relief valve 146*a*. A control compression chamber 150*a* that acts in the direction of an open position of the seat valve 101 is connected by a control pressure line 151*a* to the annular groove 110 and thus to the control pressure line 113. In the vicinity of the control compression chamber 150*a*, the piston 143 is thereby located in the valve body 136*a*. When the control compression chamber 150*a* is pressurized with control pressure, the piston 143 is deflected into the position illustrated in FIG. 3, in which the piston 143*a* is moved by the actuation device of the relief valve 146*a* into the open position and thus connects the control compression chamber 139*a* via the longitudinal boring 142*a*, the boring 144*a* and the annular groove 145*a* to the relief line 141*a* that is connected to the return line 12, as a result of which the seat valve 101 can be moved by the control pressure in the control pressure line 151*a* toward the open position.

The seat valve 102 located in the hydraulic line 19 has a construction that is identical to that of the seat valve 101. The control compression chamber 150*b* that acts toward the opening direction of the seat valve 102 is connected to a control pressure line 151*b* that leads to the annular groove 111 and is thus in communication with the control pressure line 112.

A delivery flow sensor 160 is located in the delivery line 4*a* upstream of the directional control valve 100. An additional delivery flow sensor 161 is located in the return line 12 downstream of the directional control valve 100. The delivery flow sensor 160, 161 has a valve body 171*a*, 171*b* that can move longitudinally in a housing boring 170*a*, 170*b*. The valve body 171*a*, 171*b* is provided in the vicinity of an active surface formed by an end surface 179*a*, 179*b* with a micro-control groove 172*a*, 172*b*. The valve body 171*a*, 171*b* can be moved toward the illustrated position by a spring 173*a*, 173*b* that is located in a control compression chamber 178*a*, 178*b*. The valve body 171*a*, 171*b* can be moved toward an open position by the hydraulic flow flowing into the housing boring 170*a*, 170*b* on the end surface 179*a*, 179*b*. On the valve body 171*a*, 171*b* there is also a groove 174*a*, 174*b* that makes possible a connection of the control compression chamber 178*a*, 178*b* to the delivery line 4*a* or to the return line 12. Fastened to each of the valve bodies 171*a*, 171*b* is also a permanent magnet ring 175*a*, 175*b* which is connected with a Hall sensor located in the housing 176*a*, 176*b*, which is connected with the electronic control device 72 by respective communications lines 177*a*, 177*b*.

On the consuming device 5, there can also be a feeder device 180 that is formed from spring-loaded check valves that are located in each of the hydraulic lines 18 and 19 and are connected on the input side by a hydraulic line 181 to the return line 12 downstream of the delivery flow sensor 161.

When the actuation means 70 are actuated, the pilot valves 25 and 28 are actuated by the electronic control 72 as a function of the desired direction and speed of movement. The actuation occurs with some temporal offset, so that the pilot valve 25, 28 actuated first determines the switched direction of the directional control valve 100. In addition, the electronic control 72 actuates the delivery flow adjustment device 2 of the pump 1 to correspond to the hydraulic demand of the consuming device. If the pilot valve 25 is thereby actuated before the actuation of the pilot valve 28, a control pressure is generated that corresponds to the actuation in the control pressure line 112. The control pressure line 112 is thereby connected by the annular groove 111, the transverse boring and the longitudinal boring 129 to the control compression chamber 128 of the directional control valve. The pressure in the control pressure line 112 deflects the control slide 104 of the directional control valve 100 downward in FIG. 3. The control pressure in the control pressure line 112 is also available in the control pressure line 151*b*. As a result, the seat valve 102 is moved into the open position. As a result of the deflection of the control slide of the directional control valve 100 downward in FIG. 3, the annular groove 125 is placed in communication with the annular groove 114. The communication of the control compression chamber 127 via the annular groove 125 with the control pressure line 113 is interrupted. The control compression chamber 127 is connected via the longitudinal boring 126 and the transverse boring connected to it, as well as the annular groove 125 with the annular groove 114, and thus via the branch line 116 with the return line 12 and depressurized toward the reservoir 3. The pilot valve 28 can also be actuated when the directional control valve 100 is actuated. The control pressure in the control pressure line 113 moves the seat valve 101 into the open position via the connection between the control pressure line 113 with the control pressure line 141*a*.

On the control slide of the directional control valve 100, the piston flange 120 thereby exposes an admission-side opening cross section from the delivery line 4*a* to the hydraulic line 19. The piston flange 121 exposes a discharge-side opening cross section from the hydraulic line 19 to the return line 12.

Accordingly, in the event of an actuation of the pilot valve 28 before the pilot valve 25, the control slide 104 of the directional control valve 100 is deflected upward in FIG. 3 by the control pressure in the control pressure line 113 and thus in the control compression chamber 127. The control compression chamber 128 is connected via the annular groove 130 and the annular groove 115 as well as the branch line 117 to the return line 12. The piston flange 120 thereby exposes an admission cross section from the delivery line 4*a* to the hydraulic line 19. The piston flange 122 exposes a discharge cross section from the hydraulic line 18 to the return line 12. The seat valves 101, 102 are thereby moved into the open position by the control pressures in the control pressure lines 112 and 113 and thus in the control pressure lines 151*b* and 151*a*. When only one consuming device 5 is actuated, the directional control valve 100 is opened so that no throttle losses occur.

The hydraulic flows to and from the consuming device 5 are measured by the delivery flow sensors 160, 161 and are communicated to the electronic control 72. As a result, the electronic control 72 can determine the speed of movement of the consuming device 5. By appropriate control interventions on the pilot valves 25, 28 and on the delivery flow adjustment device of the pump 1, it is possible to achieve operation of one or more consuming devices actuated simultaneously independently of the load. Operation of one or more consuming devices actuated simultaneously independently of the direction of the load is also possible. In the event of the actuation of a plurality of consuming devices, a desired distribution of the pump delivery flow corresponding to the speeds of movement set at the actuation means 70 is possible.

Figure 4:
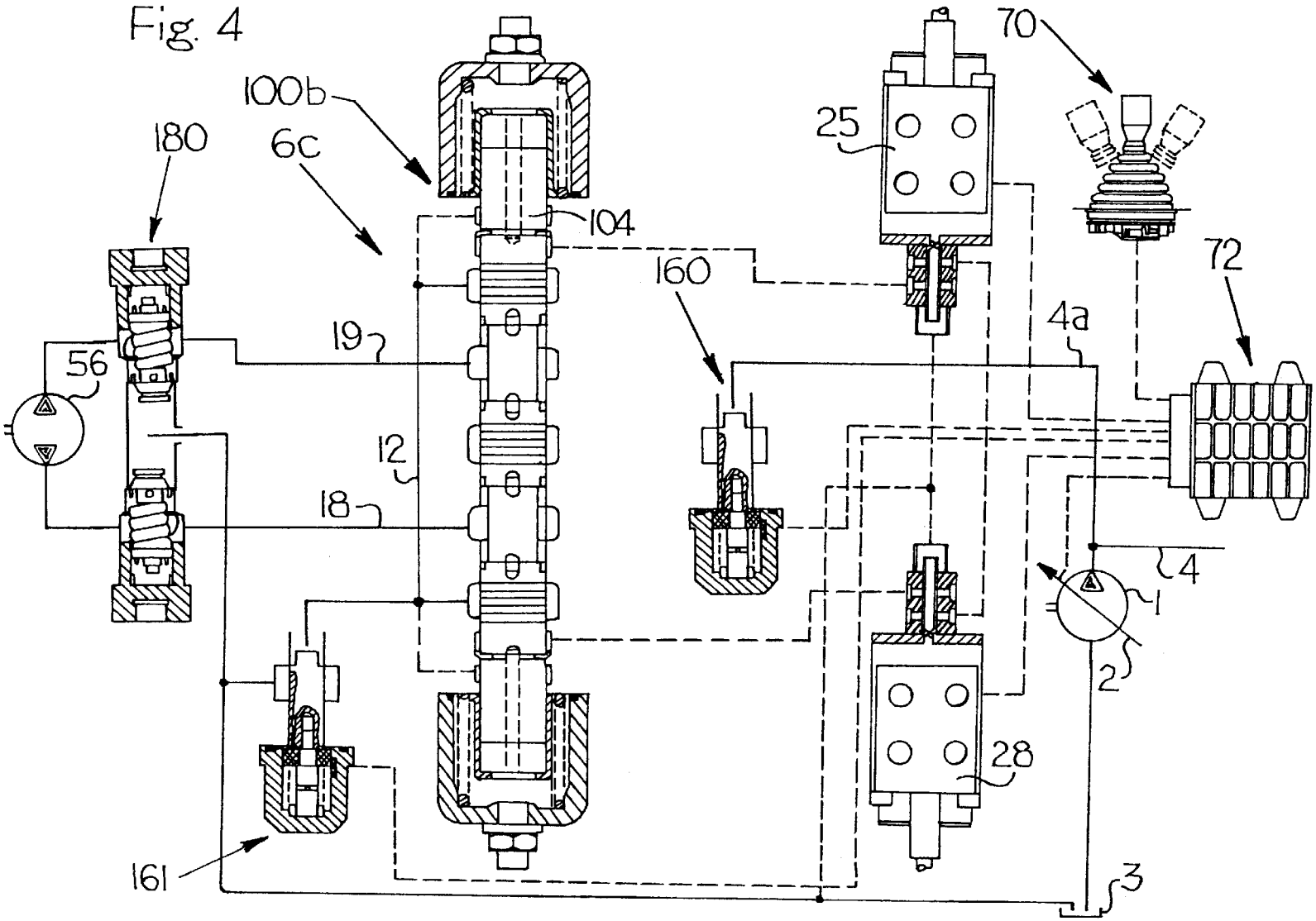
FIG. 4 schematically illustrates a variant of the third embodiment of the invention illustrated in FIG. 3.

FIG. 4 shows a variant of the drive system illustrated in FIG. 3. The consuming device 5*b* is a rotational consuming device, for example the hydraulic motor of a traction drive of a vehicle or the rotation mechanism of an excavator. The control valve device 6*c* has a directional control valve 100*b* that is substantially the same as the directional control valve 100 in FIG. 3 and can be actuated by the pilot valves 25 and 28 that are connected with the electronic control 72. In the delivery line 4*a* and the return line 12, there are respective delivery flow sensors 160 and 161 that are connected with the electronic control 72. In the hydraulic lines 18, 19 that lead from the directional control valve 100*b* to the consuming device 5*b*, there is a feeder device 180 that is in communication on the input side with the return line 12 downstream of the delivery flow sensor 161. For a rotational consuming device, the invention provides a simple control valve device 6*c*, because the tightness of the control slide 104 of the directional control valve 100 in the neutral position is sufficient for the blocking of the hydraulic motor.

Figure 5:
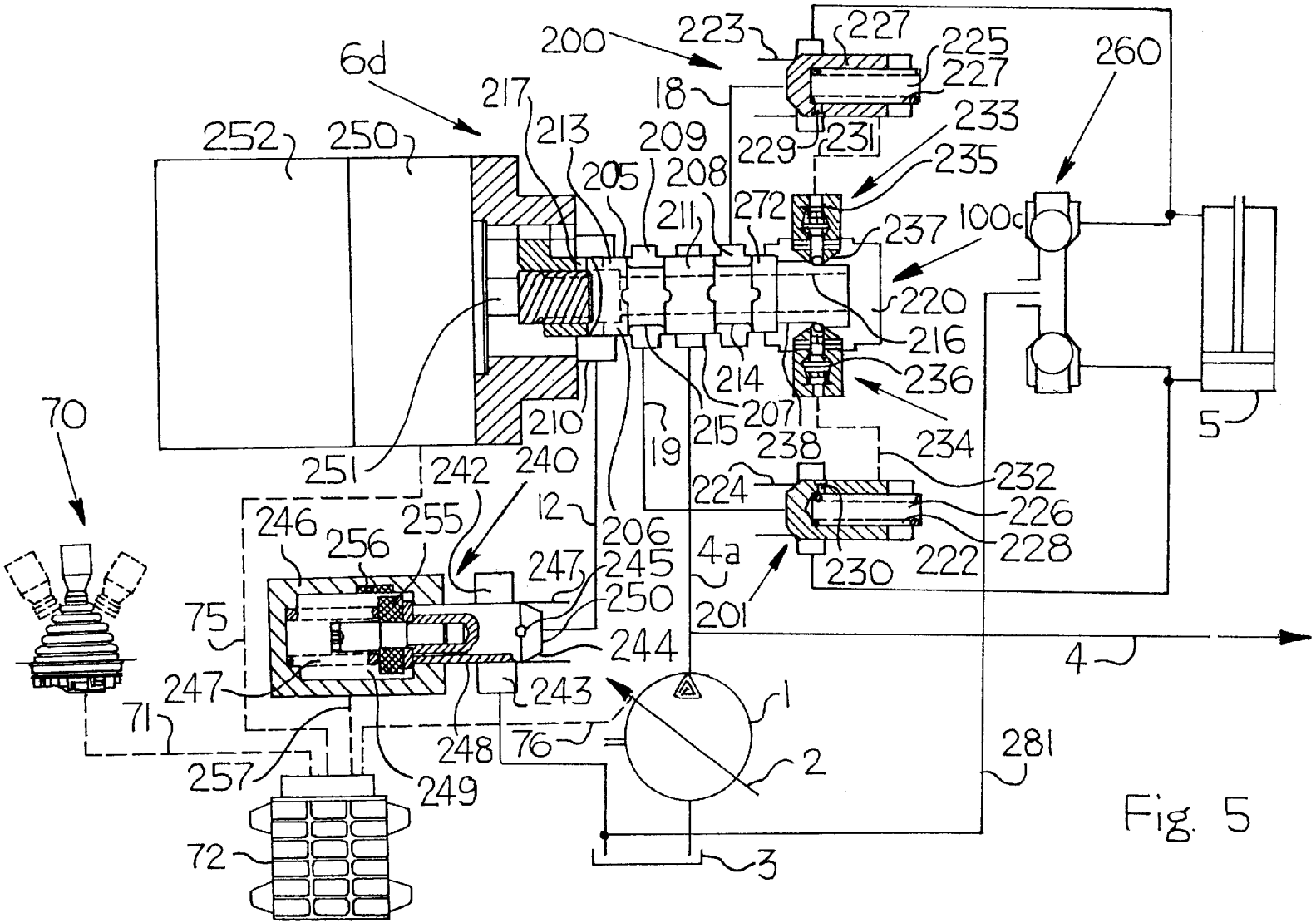
FIG. 5 schematically illustrates a fourth exemplary embodiment of the drive system according to the invention with a control valve device for the actuation of a double-action consuming device.

FIG. 5 shows an additional embodiment of a drive system according to the invention. In this case the consuming device 5 is a double-action hydraulic cylinder and can be actuated by a control valve device 6*d*. The control valve device 6*d* has a directional control valve 100*c* that controls the direction of movement and the speed of movement of the consuming device 5. The control valve device 6*d* is connected with the delivery line 4*a* of the pump 1 and the return line 12 that leads to the reservoir 3 as well as to the hydraulic lines 18, 19 that lead to the consuming device connections, and seat valves 200, 201 that are located in the hydraulic lines 18, 19 and open toward the consuming device 5. The directional control valve 100*c* can be actuated by a stepper motor 250 that is in turn actuated by the electronic control 72. The drive shaft 251 of the stepper motor 250 is connected with the control slide 206 of the directional control valve 100*c*. On the stepper motor 251 there is a spring retraction device 252 which, when the stepper motor 7 is not actuated or in the event of a power failure, moves the directional control valve 100*c* into the illustrated neutral position.

The control slide 206 of the directional control valve 100*c* can be moved longitudinally in a housing boring 205 which is provided with a plurality of annular grooves. An annular groove 207 is in communication with the delivery line 4*a* of the pump 1. Next to the annular groove 207 is an annular groove 208 which is in communication by a hydraulic line 18 with the piston-rod side compression chamber of the consuming device 5. An additional annular groove 209 next to the annular groove 207 is in communication with a hydraulic line 19 that is connected to the piston-side compression chamber of the consuming device 5. An additional annular groove 210 is connected to the return line 12.

The control slide 206 of the directional control valve 100 has piston flanges 211, 212 and 213, as well as control grooves 214 and 215 located between the piston flanges 211, 212 and 213. In the center position of the directional control valve 100*c*, the control groove 214 is in communication with the annular groove 208 and the control groove 215 is in communication with the annular groove 209. The piston flange 211 closes the annular groove 207 that is connected to the delivery line 4*a*. The control slide 206 has an axial boring 216, from which a transverse boring 217 in the vicinity of the piston flange 213 extends. On the opposite area of the control slide 206, the axial boring 216 is in communication with an annular chamber 220 in the housing boring 205.

Located in each of the hydraulic lines 18 and 19 are respective seat valves 200, 201 that open toward the consuming device 5. The seat valves 200, 201 actuate respective valve bodies 221, 222 of a seat valve formed in a housing boring 223, 224. Each seat valve 200, 201 has a control compression chamber 225, 226 that acts in the closing direction of the valve body 221, 222, in which control compression chamber there is a spring 227, 228. The control compression chamber 225, 226 is also in communication via a throttle boring 229, 230 located in the valve body 221, 222 with the segment of the hydraulic lines 18, 19 connected to the consuming device 5.

Control lines 231 and 232 that are in communication respectively with the control compression chambers 228 and 229 of the seat valves 200 and 201 emerge into the annular chamber 220. In each of the control lines 231, 232 there is a respective pilot valve 233, 234 that is a check valve that closes toward the annular chamber 220. The pilot valves 233, 234 can be mechanically actuated in the opening direction by the valve slide 205. The valve bodies 235, 236 of the pilot valves 233, 234 are in communication with connecting links 237, 238 formed on the control slide 205.

Located in the return line 12 is a delivery flow sensor 240 that has a valve body 242 that can be moved axially in a housing boring 241. The housing boring 241 connects with an annular groove 243 that is connected to the segment of the return line 12 that leads to the reservoir 3. In the vicinity of the end surface 250 located in the housing boring 241, the valve body 242 is provided with a conical surface 244. A micro-control groove 245 can be provided on the conical surface 244. The valve body 244 is moved into the illustrated position by a spring 247 that is located in a control compression chamber 249 of the housing 246. As soon as hydraulic fluid flows from the hydraulic line to the reservoir 3, the valve body 242 is deflected to the left in FIG. 5 by the hydraulic fluid flowing into the end surface 250, and by the micro-control groove 245 and the conical surface 244 exposes a connection between the hydraulic line 12 and the reservoir 3. Through a groove 248 located on the valve body 242, the control compression chamber 249 is connected with the reservoir 3. The opening travel of the valve piston 242 is thereby a measurement for the hydraulic flow being discharged from the consuming device 5. To measure the opening travel of the valve piston 242, there is a permanent magnet 255 fastened to the valve body 242 that is moved past a stationary Hall sensor 256 located in the housing 246. The Hall sensor 256 is in communication by a communications line 257 with the electronic control 72. The electronic control 72 is in turn in communication by a communications line 71 with actuation means 70, for example a joystick, and by a communications line 75 with the stepper motor 7, as well as by a communications line 76 with the delivery flow adjustment device 2 of the pump 1.

On the consuming device 5, there is a feeder device 260 that is formed from spring-loaded check valves. The feeder device 260 is connected on the output side with the hydraulic lines 18 and 19. On the input side, the feeder device 280 is in communication with a hydraulic line 281, which is connected to the hydraulic line 12 downstream of the delivery flow sensor 240.

In the event of a deflection of the control slide 205 to the right in FIG. 5, the piston flange 211, corresponding to the deflection, exposes an admission cross section from the annular groove 207 to the annular groove 209. As a result, hydraulic fluid flows from the delivery line 4*a* into the hydraulic line 19. As soon as the pressure built up in the hydraulic line 19 exceeds the load pressure in the control compression chamber 226 of the seat valve 201 and the force of the spring 228, the seat valve 201 is moved in the direction of the open position. Hydraulic fluid flows out of the delivery line 4 via the annular groove 207, the control groove 215, the annular groove 209 into the hydraulic line 19 and via the opened seat valve 201 into the piston chamber of the consuming device 5. The seat valve 201 therefore has, in this switched position of the directional control valve 100*c*, the function of a load-holding valve and when actuated prevents the descent of the consuming device 5. The piston flange 212 also opens a connection from the hydraulic line 18 into the annular chamber 220, which is in communication by the axial boring 216 and the transverse boring 217 with the annular groove 210 and thus with the return line 12. Through the connecting link 237 formed on the control slide 206, the valve body 235 of the pilot valve 233 is moved into the open position. As a result, the control compression chamber 225 of the seat valve 200 is in communication via the control line 231 and the opened pilot valve 233 with the annular chamber 220, and thus the seat valve 200 is actuated. Hydraulic fluid can therefore flow out of the piston-rod-side compression chamber of the consuming device 5 via the opened seat valve 200, the hydraulic line 18, the annular groove 208, the annular chamber 220, the axial boring 216, the transverse boring 217 into the annular groove 210 and thus into the return line 12.

In this switched position, the hydraulic line 19 represents the admission side and the hydraulic line 18 the discharge side of the consuming device 5. The seat valve 201 has the function of a load-holding valve.

Accordingly, when there is a deflection of the valve slide 206 to the left in FIG. 5 by the piston flange 211, an inlet cross section is created from the annular groove 207 to the annular groove 208. The piston flange 213 thereby creates an outlet cross section from the annular groove 209 to the annular groove 210. The connecting link 238 moves the pilot valve 234 into the open position and thereby opens the seat valve 201. In this switched position, the hydraulic line 18 represents the admission side and the hydraulic line 19 represents the discharge side of the consuming device 5. The seat valve 200 located in the admission side also has the function of a load-holding valve.

The drive system illustrated in FIG. 5 functions according to the following. In the event of an actuation of the actuation means 70 by the operator, corresponding to the deflection of the actuation means 70, one direction of motion and a desired speed of movement of the consuming device 5 is specified. The electronic control 72 actuates the stepper motor 250 corresponding to the direction of movement and the desired speed of movement set by the actuation means 70. As a result, the valve slide 206 of the directional control valve 100*c* is deflected accordingly. Simultaneously, the electronic control 72 actuates the delivery flow adjustment device 2 of the pump 1, so that the speed of movement set at the actuation means 70 is achieved. The directional control valve 100*c* is thereby actuated so that no throttle losses occur. The hydraulic fluid flowing out of the consuming device 5 in the return line 12 to the reservoir 3 is measured by the opening travel of the delivery flow sensor 240 by the electronic control 72. The actual speed of movement of the consuming device 5 is determined from the opening travel of the delivery flow sensor 240 in the electronic control 72. As a result, when there is a difference between the current speed of movement from the desired speed of movement, the electronic control 72 emits corresponding control signals to the delivery flow adjustment device 2 or to the stepper motor 250 until the speed of movement measured by the delivery flow sensor 240 equals the desired speed of movement set at the actuation means 70.

Because even with the identical speed of movement of the consuming device 5 there are different outflowing hydraulic fluid flows in the return line 12 with a different direction of movement of the consuming device 5 corresponding to the difference in surface area between the piston side and the piston-rod side, the electronic control 72 is realized so that, as a function of the direction of movement of the consuming device 5, it can determine from the piston travel of the delivery flow sensor 240 the current speed of movement of the consuming device 5. The electronic control 72 can thus determine whether the piston side or the piston-rod side of the consuming device 5 forms the discharge side, and accordingly, from the piston travel of the delivery flow sensor, the corresponding speed of movement of the consuming device 5.

As a result of the regulation of the current speed of movement of the consuming device 5 as a function of the current speed of movement measured by the delivery flow sensor 240, and from the corresponding actuation of the delivery flow adjustment device 2, the consuming device 5, when it is the only consuming device actuated, can be operated independently of the load at the speed of movement set on the actuation means 70. When a plurality of consuming devices is actuated, an increase in the speed of movement of the consuming device 5 can be measured by the delivery flow sensor 240 and the multi-way valve 100*c* can be actuated such that the speed of movement specified at the actuation means 70 can be maintained.

It is also possible, when there is a reversal of the load direction on the consuming device 5, to actuate the directional control valve 100*c* from a positive load to a negative load, so that the desired speed of movement set at the actuation means 70 can be maintained.

If the delivery flow sensor 240 supplies a signal that indicates an excessive current speed of movement of the consuming device 5, the situation can have two causes. First, there is a simultaneous actuation of a plurality of consuming devices 5, and an additional consuming device 5 requires a higher system pressure. The hydraulic fluid delivered by the pump 1 thus flows with priority to the consuming device 5 with the lower load pressure. As a result of which its actual speed of movement increases. The electronic control 72 can counteract such an operating condition by reducing the communication of the delivery line 41 with the consuming device 5 and thus of the admission cross section 100*c* at the directional control valve 100*c*, until the speed of movement measured by the delivery flow sensor 240 equals the desired speed of movement specified at the actuation means 70. Alternatively, the delivery flow sensor 240 also measures an excessive current speed of movement if, at the consuming device 5, there is a reversal of the load direction, for example from a positive load to a negative load. In the event of such a load exerted on the consuming device 5, a greater flow of hydraulic fluid flows out of the discharge side of the consuming device 5 than flows into the admission side of the consuming device 5. As a result, the speed of movement increases. Under such operating conditions, the electronic control 72 can counteract an increase in the actual speed of movement by reducing the outlet cross section on the directional control valve 100*c*. A shortage on the inlet side of the consuming device 5 can thereby be prevented by the feeder device 260.

If the delivery flow sensor 240 in the return line measures an excessive speed of movement of the consuming device 5, the electronic control 72, however, cannot detect whether this increase in the speed of movement was caused by a simultaneous actuation of a plurality of consuming devices 5 or by a reversal in the direction of the load exerted on the consuming device 5. To make possible an equalization of the speed of movement measured by the delivery flow sensor 240 to the desired speed of movement, the directional control valve 100*c* is formed so that in the event of the deflection of the valve slide 206 toward the neutral position, first the admission cross section from the pump 1 to the consuming device 5 is reduced. Consequently, in the event of the simultaneous actuation of a plurality of consuming devices 5, it is possible to counteract an increase in the speed of movement. If the delivery flow sensor 240 continues to indicate an excessive actual speed of movement, a further deflection of the valve slide 206 toward the neutral position reduces the discharge cross section. Consequently, when a negative load is applied to the consuming device 5, it is possible to counteract an increase in the speed of movement of the consuming device 5. Because in such a switched position the admission cross section from the pump 1 to the consuming device 5 is already severely reduced or may even be completely closed, the admission side of the consuming device 5 is supplied with hydraulic fluid by the feeder device 260. This makes possible a connection between the admission side of the consuming device 5 and the reservoir 3.

Figure 6:
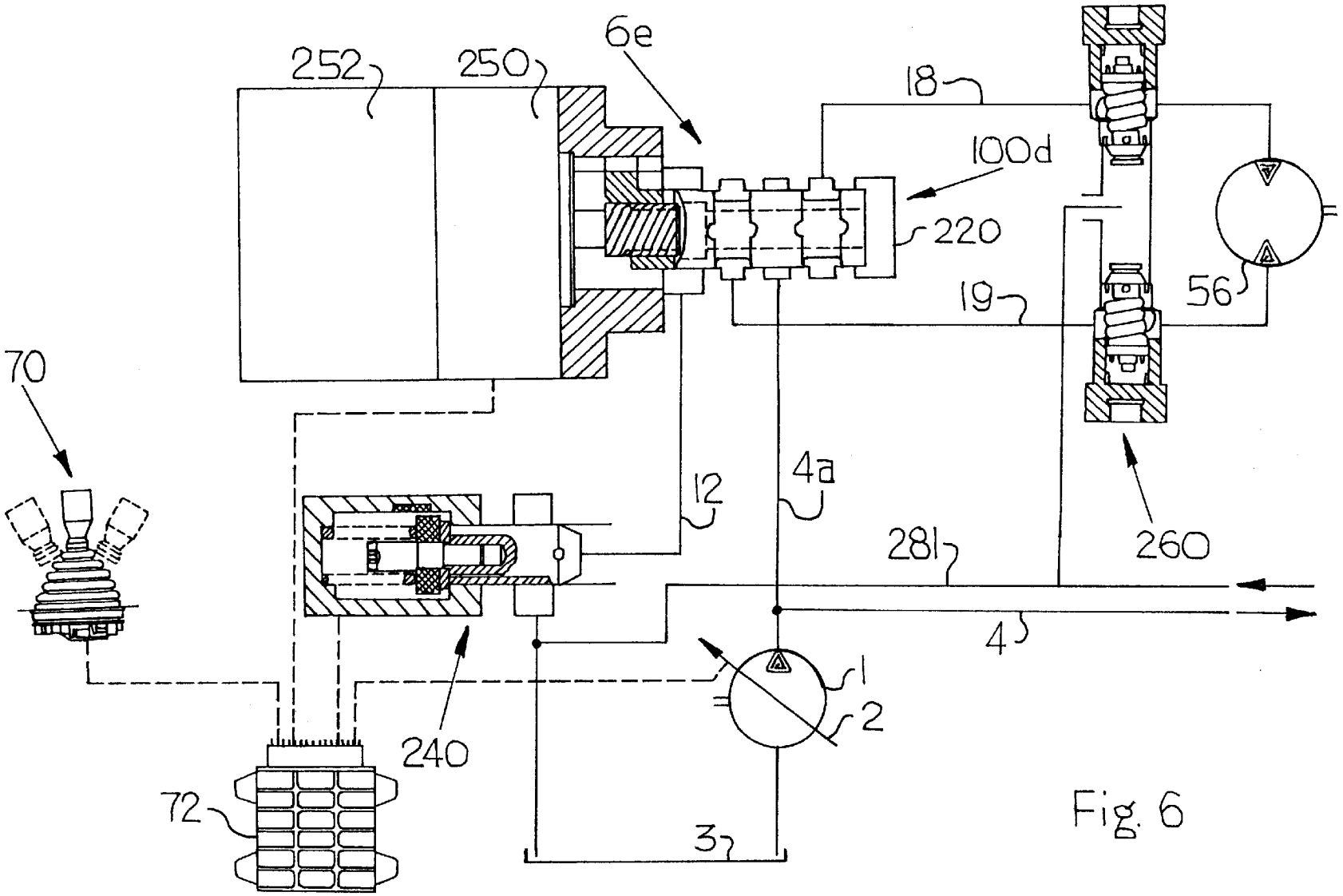
FIG. 6 schematically illustrates a variant of the fourth embodiment illustrated in FIG. 5.

FIG. 6 shows a refinement for the actuation of a rotational consuming device 5*b*. The consuming device 5*b* can be actuated by a control valve device 6*e* that comprises a directional control valve 100*d*. The construction of the directional control valve 100*d* substantially corresponds to that of the directional control valve 100*c* in FIG. 5, with the distinction that there is no piston part provided with connecting links in the annular chamber 220. In this case, there is a delivery flow sensor 240 in the return line 12.

Figure 7:
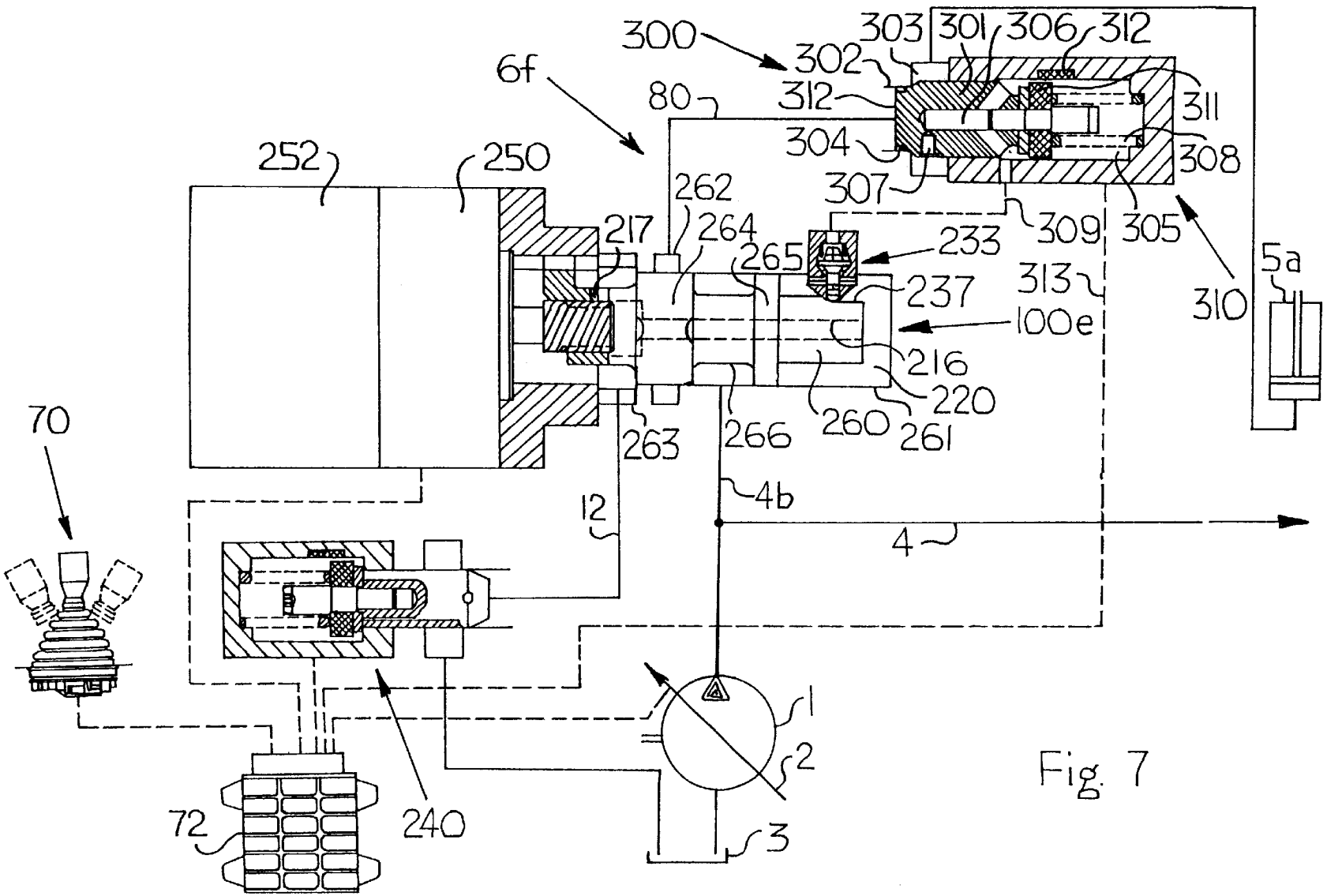
FIG. 7 schematically illustrates a fifth embodiment of the drive system according to the invention with a control valve device for the actuation of a single-action consuming device.

FIG. 7 shows one embodiment of the drive system for the actuation of a single-action consuming device 5*a*. The control valve device 6*f* has a directional control valve 100*e* that is actuated by a stepper motor 250. A seat valve 300 that opens toward the consuming device 5*a* is located in a hydraulic line 80 that leads from the directional control valve 100*e* to the consuming device 5*a*. A delivery flow sensor 240 is located in a return line 12 that leads from the directional control valve 100*e* to the reservoir. The control slide 260 of the directional control valve 100*e* is mounted so that it can move longitudinally in a longitudinal boring 261 which is in communication by an annular groove 262 with the hydraulic line 80 that leads to the consuming device and by an annular groove 263 with the return line 12. The control slide has a piston flange 264 that is provided in the vicinity of the annular groove 262 and a piston flange 265. Between the piston flanges 264 and 265 there is a control groove 266, in the vicinity of which the delivery line 4*a* is connected to the housing boring 261. An annular space formed between the piston flange 265 and the housing boring 261 is connected to the annular groove 263 by a longitudinal boring 216 in the control slide 260 and a transverse boring 217 that branches off from the longitudinal boring 216.

The seat valve 300 located in the hydraulic line 80 is a delivery flow sensor 310, or a delivery flow sensor 310 is integrated into the seat valve 300. The valve body 301 of the delivery flow sensor 310 forms a valve seat at the transition of a housing boring 302 that is in communication with the segment of the hydraulic line 80 leading to the directional control valve 10*e* and of an annular space 303 to which the segment of the hydraulic line 80 leading to the consuming device 5*a* is connected. In the vicinity of the valve seat, a micro-control groove 304 is also provided on the valve body 301 in the vicinity of the end surface 312. A control compression chamber 305 that acts in the closing direction of the valve body 301 is in communication with the annular space 303 via a boring system 306 located in the valve body and a throttle boring 307 connected with it. A spring 308 is also located in the control compression chamber 305. The control compression chamber 305 of the delivery flow sensor 310 is in communication with the annular space 220 via a control pressure line 309. Located in the control pressure line 307 is a pilot valve 233 that can be moved into the open position by the control slide 260 by a connecting link 237 located on the control slide 260. Fastened to the valve body 301 of the delivery flow sensor 301 there is a permanent magnet body 311 that is connected with a Hall sensor 312. The Hall sensor 312 is connected to the electronic control 72 by a communications line 313.

In the event of a deflection of the control slide 20 to the left in FIG. 7, for example to raise a load on the consuming device, the piston flange 264 exposes an opening cross section from the delivery line 4*a* to the hydraulic line 80. As a result, hydraulic fluid flows from the delivery line 4*a* into the hydraulic line 80. The delivery flow sensor 310 is a seat valve 300 and performs both the function of the load-holding valve and the function of the delivery flow sensor to measure the flow of hydraulic current into the consuming device 5*a*. Through the electronic control 72, the consuming device 5*a* can therefore be controlled independently of the load, corresponding to the speed of movement of the consuming device 5*a* specified at the actuation means 70 and the speed of movement measured by the delivery flow sensor 310.

In the event of a deflection of the control slide 260 to the right in FIG. 7, for example to lower a load, the control slide 260 connects the hydraulic line 80 by the piston flange 264 with the annular space 263 and thus with the return line 12. The piston flange 264 exposes a discharge cross section. The pilot valve 233 is moved into the open position by the connecting link 237, and thus the seat valve 300 is actuated. The flow of hydraulic current discharged from the consuming device 5*a* to the reservoir 3 and thus the actual speed of movement of the consuming device 5*a* is measured by the delivery flow sensor 240 located in the return line 12. The consuming device 5*a* can therefore be operated independently of the load applied to the consuming device 5*a* at the speed of movement set at the actuation means 70.

In the event of the simultaneous actuation of an additional consuming device at a higher load pressure, the delivery flow sensor 310 can measure an increase in the speed of movement, and an increase in the speed of movement can be counteracted by a corresponding deflection of the directional control valve 100*e*.

Figure 8:
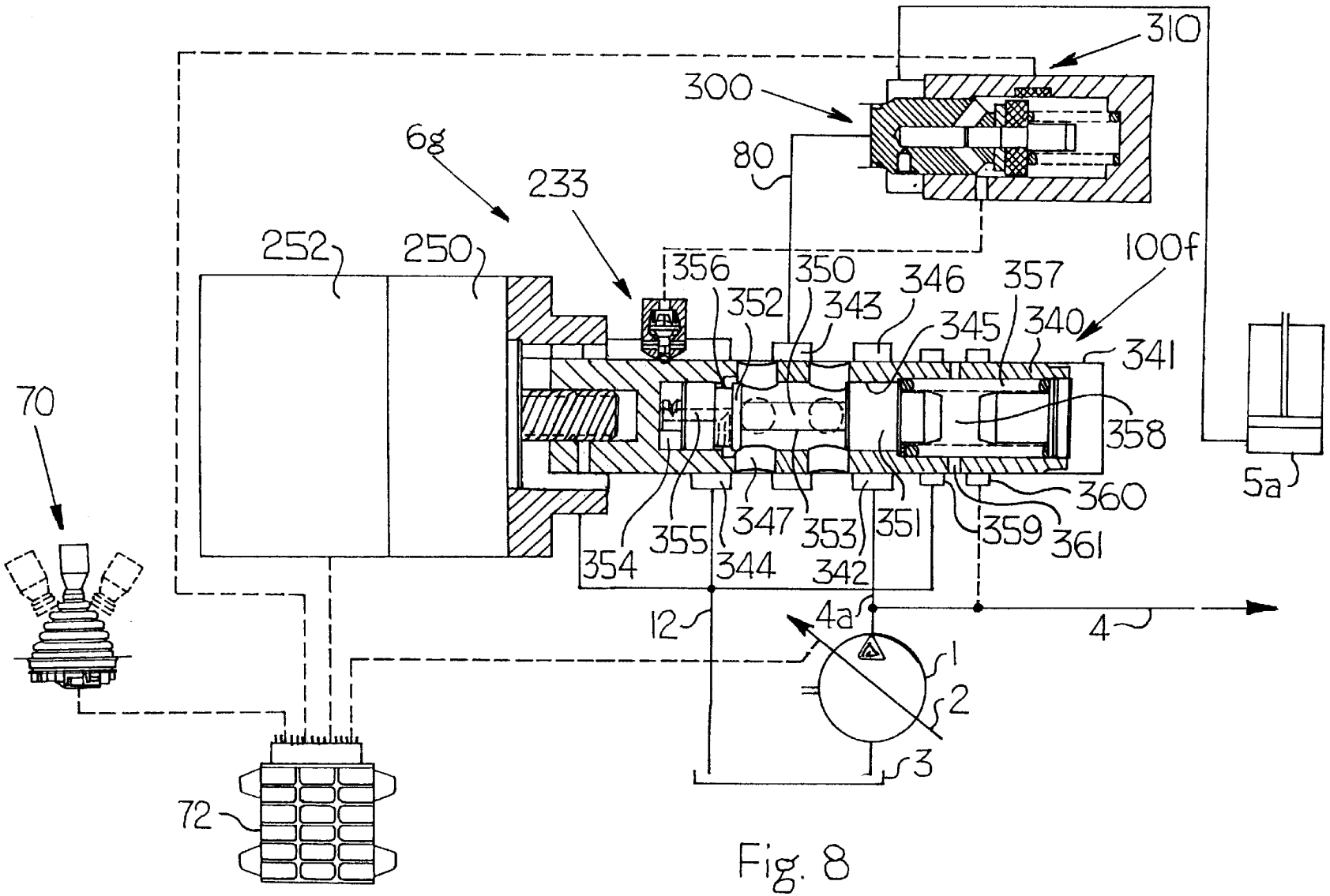
FIG. 8 schematically illustrates a sixth exemplary embodiment of a drive system according to the invention with a control valve device for the actuation of a single-action consuming device.

FIG. 8 shows an additional embodiment of a hydrostatic drive system for the actuation of a single-action consuming device 5*a*. The control valve device 6*g* has a directional control valve 100f and a delivery flow sensor 310 in the form of a seat valve 300 in the hydraulic line 80 that leads from the directional control valve 100*f* to the consuming device 5*a*. The seat valve 300 can thereby be actuated by means of a pilot valve 223 that can be actuated by the control slide 340 of the directional control valve 100*f*.

The directional control valve 100*f* has a control slide 340 that is mounted so that it can move longitudinally in a housing boring 341 and can be actuated by a stepper motor 250. In the housing boring 241, there is an annular groove 342 that is in communication with the delivery line 4*a*, an annular groove 343 that is in communication with the hydraulic line 80, and an annular groove 344 that is connected to the return line 12. The control slide 340 is provided with a longitudinal boring 345, from which transverse borings 346 and 347 proceed. The transverse borings 346, 347 are thereby oriented so that in the illustrated neutral position of the control slide 340, the transverse borings 346, 347 are in communication with the annular groove 343. In the longitudinal boring 345 there is a longitudinally movable flow regulator 350 that has piston flanges 351, 352 and a control groove 353 located between them. The piston flange 352, with the longitudinal boring 345, forms a control compression chamber 354 which is in communication via a boring 355 with an annular groove 356 formed in the vicinity of the piston flange 352. The annular groove 356 and thus the control compression chamber 354, in the illustrated position of the flow regulator 350, is connected to the compression chamber formed between the control groove 353 and the longitudinal boring 345. In the illustrated switched position, the flow regulator 350 can be moved by a spring 357 that is located in a control compression chamber 358 formed between the piston flange 351 and the longitudinal boring 345. The control compression chamber 358 can be placed in communication by a transverse boring 361 located in the control slide 350, depending on the deflection of the control slide 350, with an annular groove 359 or 360 located in the housing boring 341. The annular groove 359 is thereby connected to the return line 12. The annular groove 360 is in communication with the delivery line 4 of the pump 1.

In the event of the deflection of the actuation means 70 to lift a load that is applied to the consuming device 5*a*, the electronic control 72 actuates the stepper motor 250 such that the control slide 350 of the directional control valve 100f is deflected to the right in FIG. 8. The transverse boring 346 is thereby placed in communication with the annular groove 342 and the transverse boring 347 with the annular groove 343, so that hydraulic fluid flows from the delivery line 4*a* to the hydraulic line 80. The transverse boring 346 thereby determines the size of the admission cross section from the delivery line 4*a* to the hydraulic line 80 as a function of the displacement of the slide. The transverse boring 361 is thereby placed in communication with the annular groove 360. As a result, the control compression chamber 358 of the flow regulator 350 is pressurized by the delivery pressure of the pump, and thus the flow regulator 350 stays in the illustrated position. The seat valve 300 has the function of a load-holding valve. As soon as the pressure that builds up in the hydraulic line 80 is sufficient to move the seat valve 300 toward the open position, the flow of hydraulic fluid into the consuming device 5*a* is measured by the deflection of the valve body of the seat valve 300 by means of the Hall sensor, and the signal is sent to the electronic control 72, which also actuates the delivery flow adjustment device 2 on the pump 1. The speed of movement of the consuming device 5*a* can thus be measured by the delivery flow sensor 310 realized in the form of a seat valve 300. As a result, the electronic control 72 can control the operation of the consuming device 5*a* independently of the load when the consuming device 5 is actuated by itself. The electronic control 72 can also operate the actuated consuming devices independently of the load, when a plurality of consuming devices are actuated simultaneously by dividing the delivery flow of the pump in an equitable manner.

When the actuation means 70 are deflected toward a switched position to lower a load that has been lifted by the consuming device 5*a*, the electronic control 72 actuates the control slide 340 of the directional control valve 100*f* to the left in FIG. 8, as a function of the speed of movement set at the actuation means 70. The transverse boring 346 is placed in communication with the annular groove 343 and the transverse boring 347 with the annular groove 344. The transverse boring 347 thereby defines, as a function of the deflection of the control slide 340, a discharge cross section from the hydraulic line 80 to the return line 12. The control compression chamber 358 is in communication via the transverse boring 359 with the return line 12 downstream of the control slide 340. The compression in the compression chamber formed between the control groove 353 and the longitudinal boring 345 upstream of the discharge cross section formed by the transverse boring 347 is available via the boring 355 in the control compression chamber 354. The compression moves the flow regulator 350 against the force of the spring 357 to the left in FIG. 8. As a result, the piston flange 352 actuates the connection of the control groove 353 with the transverse boring 347 and thus the discharge cross section. The flow regulator 350 thus keeps the pressure difference at the discharge cross section from the consuming device 5*a* to the reservoir 3 defined by the spring 357 constant. As a result, the speed of descent of the consuming device 5*a* can be controlled independently of the load as a function of the deflection of the control slide 340. The consuming device 5*a* can thus be controlled during the descent independently of the load at the desired speed of movement set at the actuation means 70, which speed is associated with a defined deflection of the control slide 340.

The embodiments described above are illustrative of the present invention and not restrictive thereof. It will be evident that various changes may be made to the present invention without departing from the spirit and scope thereof. Consequently the present invention is defined by the appended claims and equivalents thereto.

We claim:

1. A hydrostatic drive system for at least one consuming device, the hydrostatic drive system comprising:

an adjustable pump connected to the at least one consuming device, the pump having a delivery flow setting device, actuation means associated with each consuming device for specifying the direction of movement and the speed of movement of each consuming device, a control valve device associated with each consuming device to control the direction of movement and the speed of movement of each consuming device, wherein the consuming device is connected by the control valve device to a delivery line of the pump and to a return line connected to a reservoir, wherein the delivery flow of the pump can be adjusted to the hydraulic flow required by the actuated consuming devices, delivery flow sensors associated with each consuming device, wherein there are respective delivery flow sensors located in the delivery line and in the return line and wherein the delivery flow sensors measure the hydraulic flow associated with the consuming device, and an electronic control connected to the delivery flow sensors, to the actuation means, to the control valve device and to the delivery flow setting device of the pump, wherein the electronic control controls at least one of the control valve device and the delivery flow setting device of the pump as a function of the direction of movement and the speed of movement specified by the actuation means and of the hydraulic flow associated with the consuming device as measured by the delivery flow sensors.

2. The hydrostatic drive system as claimed in claim 1, wherein the consuming device is a double-action consuming device.

3. The hydrostatic drive system as claimed in claim 2, further including at least one hydraulic line leading to each consuming device and a seat valve in each of the hydraulic lines that lead to the consuming device, each seat valve movable toward a closed position by the load pressure of the consuming device and by a spring.

4. The hydrostatic drive system as claimed in claim 3, wherein each hydraulic line is connected with the return line by the control valve device.

5. The hydrostatic drive system as claimed in claim 3, wherein the control valve device in a neutral position connects the hydraulic lines that lead from the control valve device to the consuming device with the return line.

6. The hydrostatic drive system as claimed in claim 2, further including two electrically actuated, proportional pilot valves to actuate the control valve device, wherein the two electrically actuated, proportional pilot valves are connected to the electronic control and generate a control pressure to pressurize the control valve device.

7. The hydrostatic drive system as claimed in claim 6, wherein the electronic control actuates the pilot valves with a temporal offset, wherein the pilot valve that is actuated first generates a control pressure that acts on the control valve device and the control pressure formed by the pilot valve that is actuated later generates a control pressure that acts on the control valve device.

8. The hydrostatic drive system as claimed in claim 2, further including a stepper motor, wherein the control valve device can be actuated by the stepper motor that is connected with the electronic control device.

9. The hydrostatic drive system as claimed in claim 8, wherein the stepper motor is provided with a spring retraction device.

10. The hydrostatic drive system as claimed in claim 1, wherein the consuming device is a single-action consuming device.

11. The hydrostatic drive system as claimed in claim 10, wherein a hydraulic line connects the control valve device and the consuming device and the control valve device is connected to the delivery line of the pump and to the return line that is in communication with the reservoir, and the control valve device is in communication with a circulation line, wherein a first switched position of the control valve device connects the hydraulic line with the return line, and a second switched position of the control valve device creates a connection between the delivery line and the hydraulic line, and wherein a delivery flow sensor is located in the circulation line.

12. The hydrostatic drive system as claimed in claim 1, wherein each delivery flow sensor has a valve body that can move the longitudinally in a housing boring; the delivery flow sensor valve body can be moved by a spring toward a closed position, and the valve body can be moved toward an open position by hydraulic fluid flowing to the valve body on an end surface.

13. The hydrostatic drive system as claimed in claim 12, wherein the deflection of the valve body of each delivery flow sensor can be measured by an inductive sensor.

14. The hydrostatic drive system as claimed in claim 12, wherein the valve body of each delivery flow sensor is connected with a Hall sensor.

15. The hydrostatic drive system as claimed in claim 14, wherein the valve of each delivery flow sensor is provided with a permanent magnet body connected with a Hall sensor that is located in a housing of the delivery flow sensor and is connected with the electronic control.

16. The hydrostatic drive system as claimed in claim 12, wherein the valve body of the delivery flow sensor is provided with a micro-control device.

17. A hydrostatic drive system for at least one consuming device, the hydrostatic drive system comprising:

an adjustable pump connected to the at least one consuming device, the pump having a delivery flow setting device, an actuation means associated with each consuming device for specifying the direction of movement and the speed of movement of each consuming device, a control valve device associated with each consuming device to control the direction of movement and the speed of movement of each consuming device wherein the delivery flow of the pump can be adjusted to the hydraulic flow required by the actuated consuming devices, at least one delivery flow sensor associated with each consuming device, wherein the delivery flow sensor measures the hydraulic flow associated with the consuming device, and an electronic control connected to the at least one delivery flow sensor, to the actuation means, to the control valve device and to the delivery flow setting device of the pump, wherein the electronic control controls at least one of the control valve device and the delivery flow setting device of the pump as a function of the direction of movement and the speed of movement specified by the actuation means and of the hydraulic flow associated with the consuming device as measured by the at least one delivery flow sensor, wherein the consuming device is a double-action consuming device connected by the control valve device to a delivery line of the pump and to a return line that is in communication with a reservoir, and wherein a delivery flow sensor is located in a return line that leads from the control valve device to the reservoir.

18. The hydrostatic drive system as claimed in claim 17, wherein when the control valve device is actuated toward a neutral position, the admission cross section formed by the control valve device from the pump to the consuming device can be throttled upstream of the discharge section formed by the control valve device from the consuming device to the reservoir.

19. The hydrostatic drive system as claimed in claim 18, further including a feeder device on the consuming device, the feeder device in communication on the input side with the return line downstream of the delivery flow sensor.

20. A hydrostatic drive system for at least one consuming device, wherein the consuming device is a single-action consuming device, the hydrostatic drive system comprising:

an adjustable pump connected to the at least one consuming device, the pump having a delivery flow setting device, actuation means associated with each consuming device for specifying the direction of movement and the speed of movement of each consuming device, a control valve device associated with each consuming device to control the direction of movement and the speed of movement of each consuming device, wherein the consuming device is connected by the control valve device to a delivery line of the pump and the delivery flow of the pump can be adjusted to the hydraulic flow required by the actuated consuming devices, at least one delivery flow sensor associated with each consuming device, wherein the at least one delivery flow sensor measures the hydraulic flow associated with the consuming device and wherein a delivery flow sensor is located in a hydraulic line that leads from the control valve device to the consuming device, an electronic control connected to the at least one delivery flow sensor, to the actuation means, to the control valve device and to the delivery flow setting device of the pump, wherein the electronic control controls at least one of the control valve device and the delivery flow setting device of the pump as a function of the direction of movement and the speed of movement specified by the actuation means and of the hydraulic flow associated with the consuming device as measured by the at least one delivery flow sensor, and a flow regulator to control the hydraulic flow from the consuming device to a reservoir independently of the load.

21. The hydrostatic drive system as claimed in claim 20, wherein the flow regulator can be moved toward a first switched position which reduces a discharge cross section formed by the control valve device and toward a second switched position that exposes the admission cross section formed by the control valve device.

22. The hydrostatic drive system as claimed in claim 21, wherein the flow regulator is integrated into a control slide of the control valve device.

23. A hydrostatic drive system for at least one consuming device the hydrostatic drive system comprising:

an adjustable pump connected to the at least one consuming device, the pump having a delivery flow setting device, actuation means associated with each consuming device for specifying the direction of movement and the speed of movement of each consuming device, a control valve device associated with each consuming device to control the direction of movement and the speed of movement of each consuming device, wherein the consuming device is connected by the control valve device to a delivery line of the pump and the delivery flow of the pump can be adjusted to the hydraulic flow required by the actuated consuming devices, and wherein the control valve device has a reversing valve that controls the direction of movement of the consuming device and at least one control valve that controls the speed of the movement of the consuming device, and at least one delivery flow sensor associated with each consuming device, wherein the at least one delivery flow sensor measures the hydraulic flow associated with the consuming device, and an electronic control connected to the at least one delivery flow sensor, to the actuation means, to the control valve device and to the delivery flow setting device of the pump, wherein the electronic control controls at least one of the control valve device and the delivery flow setting device of the pump as a function of the direction of movement and the speed of movement specified by the actuation means and of the hydraulic flow associated with the consuming device as measured by the at least one delivery flow sensor.

24. The hydrostatic drive system as claimed in claim 23, wherein the reversing valve has a first control compression chamber that acts toward a first switched position, wherein in the first switched position the delivery line of the pump is connected to a first hydraulic line and a second hydraulic line is connected to a return line which is connected to a reservoir, and the reversing valve has a second control compression chamber that moves the reversing valve into a second switched position, wherein in the second switched position the first hydraulic line is connected to the return line and the second hydraulic line is connected to the delivery line, and further including a first pilot valve and a first control pressure line in communication with the first pilot valve, wherein the first control compression chamber is connected to the first control pressure line that is in communication with the first pilot valve, the first control pressure line in communication with a control compression chamber that moves the control valve located in the first hydraulic line toward the open position, and a second pilot valve and a second control pressure line in communication with the second pilot valve, wherein the second control compression chamber is connected to the second control pressure line that is in communication with the second pilot valve, the second control pressure line in communication with a control compression chamber that moves the control valve located in the second hydraulic line toward the open position.

25. The hydrostatic drive system as claimed in claim 24, wherein the pilot valves are connected by respective control pressure lines to the reversing valve and to the control valve.

26. The hydrostatic drive system as claimed in claim 23, further including a pilot valve that has a switching magnet and an electrically actuated proportional pilot valve that is connected with the electronic control, wherein the reversing valve is spring loaded in the direction of a first switched position in which a hydraulic line leading to the consuming device is in communication with a return line which is connected to a reservoir and the reversing valve moveable in the direction of a second switched position in which the hydraulic line is connected to the delivery line by the pilot valve, wherein the pilot valve generates a control pressure and is in communication with the electronic control and wherein the electrically actuated proportional pilot valve generates a control pressure to move the control valve.

27. A hydrostatic drive system for at least one consuming device the hydrostatic drive system comprising:

an adjustable pump connected to the at least one consuming device, the pump having a delivery flow setting device, actuation means associated with each consuming device for specifying the direction of movement and the speed of movement of each consuming device, a control valve device associated with each consuming device to control the direction of movement and the speed of movement of each consuming device, wherein the consuming device is connected by the control valve device to a delivery line of the pump and the delivery flow of the pump can be adjusted to the hydraulic flow required by the actuated consuming devices, and wherein the control valve device is a directional control valve that controls the direction of movement of the consuming device and the speed of the movement of the consuming device and throttles the flow in intermediate positions, at least one delivery flow sensor associated with each consuming device, wherein the at least one delivery flow sensor measures the hydraulic flow associated with the consuming device, and an electronic control connected to the at least one delivery flow sensor, to the actuation means, to the control valve device and to the delivery flow setting device of the pump, wherein the electronic control controls at least one of the control valve device and the delivery flow setting device of the pump as a function of the direction of movement and the speed of movement specified by the actuation means and of the hydraulic flow associated with the consuming device as measured by the at least one delivery flow sensor, wherein the directional control valve has a first control compression chamber that moves the directional control valve toward a first switched position and a second control compression chamber that moves it toward a second switched position, wherein in the first switched position the delivery line is connected to a first hydraulic line and a second hydraulic line is connected to a return line which is connected to a reservoir, and in the second switched position the second hydraulic line is in communication with the delivery line and the first hydraulic line is in communication with the return line.

28. The hydrostatic drive system as claimed in claim 27, wherein a control pressure line connected to a first pilot valve that is in communication with the first control compression chamber of the directional control valve, and the control pressure line is connected to a second pilot valve that is in communication with the second control pressure chamber of the directional control valve.

29. The hydrostatic drive system as claimed in claim 28, wherein the control pressure line is connected to an annular groove formed in a housing boring of the control valve of the directional control valve, wherein the annular groove is connected to the control pressure line of the pilot valve.

30. The hydrostatic drive system as claimed in claim 27, further including a pilot valve actuated by the directional control valve.

31. The hydrostatic drive system as claimed in claim 30, wherein the pilot valve is a spring-loaded check valve and has a valve body that can be moved into the open position by a control slide of the directional valve.

32. The hydrostatic drive system as claimed in claim 23, wherein the control valve is a seat valve.

33. The hydrostatic drive system as claimed in claim 2, wherein the delivery flow sensor is a seat valve.

* * * * *

UNITED STATES PATENT AND TRADEMARK OFFICE

CERTIFICATE OF CORRECTION

PATENT NO. : 6,295,810 B1
DATED : October 2, 2001
INVENTOR(S) : Alfred Langen and Horst Deininger It is certified that error appears in the above-identified patent and that said Letters Patent is hereby corrected as shown below:

Column 2,
Line 63, "device a s" should read -- device as --.

Column 12,
Line 38, "valve seat" should read -- a valve seat --.

Column 13,
Line 8, "48*b*that" should read -- 48*b* that -- (insert space).

Column 15,
Line 5, "double-reaction" should read -- double-action --.

Column 25,
Line 15, "control valve 10e" should read -- control valve 100e --.

Column 29, claim 12,
Line 8, "move the longitudinally" should read -- move longitudinally --.

Column 29, claim 15,
Line 19, "wherein the valve of" should read -- wherein the valve body of --.

Column 29, claim 18,
Line 65, "discharge section" should read -- discharge cross section --.

Column 32, claim 31,
Line 61, "directional valve." should read -- directional control valve --.

Signed and Sealed this

Twelfth Day of March, 2002

*Attest:*

*Attesting Officer*

JAMES E. ROGAN
*Director of the United States Patent and Trademark Office*